US010060243B2

(12) United States Patent
Graf et al.

(10) Patent No.: US 10,060,243 B2
(45) **Date of Patent: *Aug. 28, 2018**

(54) MULTISTAGE FRACTURING SYSTEM WITH ELECTRONIC COUNTING SYSTEM

(71) Applicant: COMPLETIONS RESEARCH AG, Lucerne (CH)

(72) Inventors: Robert James Graf, Calgary (CA); Robert Steve Smolka, Calgary (CA)

(73) Assignee: Completions Research AG, Lucerne (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/668,353

(22) Filed: Aug. 3, 2017

(65) Prior Publication Data

US 2017/0328188 A1 Nov. 16, 2017

Related U.S. Application Data

(63) Continuation of application No. 15/002,532, filed on Jan. 21, 2016, now Pat. No. 9,752,409.

(51) Int. Cl.

| | |
|---|---|
| ***E21B 34/06*** | (2006.01) |
| ***E21B 43/26*** | (2006.01) |
| ***E21B 23/00*** | (2006.01) |
| ***E21B 34/14*** | (2006.01) |
| ***E21B 43/14*** | (2006.01) |
| *E21B 34/00* | (2006.01) |

(52) U.S. Cl.

CPC ..... *E21B 43/26* (2013.01); *E21B 23/004* (2013.01); *E21B 34/063* (2013.01); *E21B 34/066* (2013.01); *E21B 34/14* (2013.01); *E21B 43/14* (2013.01); *E21B 2034/007* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,752,409 | B2 * | 9/2017 | Graf | E21B 34/066 |
| 2013/0220603 | A1 * | 8/2013 | Robison | E21B 23/006 166/250.04 |
| 2014/0262234 | A1 * | 9/2014 | Walton | E21B 34/06 166/250.01 |

* cited by examiner

*Primary Examiner* — D. Andrews
*Assistant Examiner* — Ronald R Runyan
(74) *Attorney, Agent, or Firm* — Morgan, Lewis & Bockius LLP

(57) ABSTRACT

The invention relates to a multistage high pressure fracturing system and tubular hydraulic valve (THV) system for connection to a completion string to enable isolation of a zone of interest within a well. In particular, the system enables access to a downhole formation for fracturing the zone of interest and for hydrocarbon production. The system generally includes an electronic plug counting system, a plug capture system and a valve system wherein dropping a series of plugs down the completion string enables successive capture of individual plugs within individual THVs for subsequent fracturing operations.

28 Claims, 16 Drawing Sheets

MULTISTAGE FRACTURING SYSTEM WITH ELECTRONIC COUNTING SYSTEM

FIELD OF THE INVENTION

The invention relates to a multistage high pressure fracturing system and tubular hydraulic valve (THV) system for connection to a completion string to enable isolation of a zone of interest within a well. In particular, the system enables access to a downhole formation for fracturing the zone of interest and for hydrocarbon production. The system generally includes an electronic plug counting system, a plug capture system and a valve system wherein dropping a series of plugs down the completion string enables successive capture of individual plugs within individual THVs for subsequent fracturing operations.

BACKGROUND OF THE INVENTION

In the oil and gas industry, during well completion operations, there is often a need to conduct different operations at various zones within the well in order to enhance production from the well. That is, within a particular well, there may be several zones of economic interest that after drilling and/or casing, the operator may wish to access the well directly and/or open the casing in order to conduct fracturing operations to promote the migration of hydrocarbons from the formation to the well for production.

In the past, there have been a number of techniques that operators have utilized in cased wells to isolate one or more zones of interest to enable access to the formation as well as to conduct fracturing operations. In the simplest situation, a cased well may simply need to be opened at an appropriate location to enable hydrocarbons to flow into the well. In this case, the casing of the well (and any associated cement) may be penetrated at the desired location such that interior of the well casing is exposed to the formation and hydrocarbons can migrate from the formation to the interior of the well.

While this basic technique has been utilized in the past, it has been generally recognized that the complexity of penetrating steel casing/cement at a desired zone is more complicated and more likely to be subject to complications than positioning specialized sections of casing adjacent a zone of interest and then opening that section after the well has been cased. Generally, if a specialized section of casing is positioned adjacent a zone of interest, various techniques can be utilized to effectively open one or more ports in a section of casing without the need to physically cut through the steel casing.

In other situations, particularly if there is a need to fracture one or more zones of the formation, systems and techniques have been developed to isolate particular sections of the well in order to both enable selective opening of specialized ports in the casing and conduct fracturing operations within a single zone.

One such technique is to incorporate packer elements and various specialized pieces equipment into one or more tubing strings, run the tubing string(s) into the well and conduct various hydraulic operations to effect opening of ports within the tubing strings.

Importantly, while these techniques have been effective, there has been a need for systems and methods that minimize the complexity of such systems. That is, any operation involving downhole equipment is expensive in terms of capital/rental cost and time required to complete such operations. Thus, to the extent that the complexity of the equipment can be reduced and/or the time/personnel required to conduct such operations, such systems can provide significant economic advantages to the operator.

In the past, such techniques of isolating sections of a well have included systems that utilize balls within a tubing string to enable successive areas of a tubing string to be isolated. In these systems, a ball is dropped/pumped down the tubing string where it may engage with specialized seats within the string and thereby seal off a lower section of the well from an upper section of the well. In the past, in order to ensure that a lower section is sealed before an upper section, a series of balls having different diameters are dropped down the tubing starting with a smallest diameter ball and progressing uphole with progressively larger balls. Typically, each ball may vary in diameter by $1/8^{th}$ of an inch and will engage with a downhole seat sized to engage with a specific diameter ball only. While effective, this system is practically limited by the range in diameters in balls. That is, to enable 16 zones of interest to be isolated, the smallest ball would be 2 inches smaller in diameter compared to the largest ball. As a result, there are practical limitations in the number of zones that can be incorporated into a tubing string which thus limits the number of zones that can be fracturing. As a modern well may wish to conduct up to approximately 40 fracturing operations and possibly more than 40 fractures, current ball drop and capture systems cannot be incorporated into such wells.

Thus, there has been a need for a system that is not limited by the size of the balls being dropped and that can enable a significantly larger number of fracturing windows to be incorporated within a tubing string.

SUMMARY OF THE INVENTION

In accordance with the invention, there is provided a tubular hydraulic valve (THV) system for connection to a completion string to enable isolation of a zone of interest within a well, to enable access to a downhole formation for fracturing the zone of interest and for hydrocarbon production, the THV having an internal bore enabling a plug to pass through the THV, the THV comprising: an electronic plug counting system having an uphole end for connection to a completion string and a plug engagement system for engagement with a plug passing through the internal bore, the plug engagement system for counting successive plugs passing through the electronic plug counting system and for triggering a first hydraulic event when a pre-set number of plugs passing through the internal bore is reached; a valved plug capture system operatively connected to the electronic plug counting system, the electronic plug counting system responsive to the first hydraulic event to effect plug capture within the THV when the first hydraulic event is triggered; a valved frac port system operatively connected to the electronic plug counting system and plug capture system, the valved frac port system including a valve responsive to plug capture to open one or more frac ports to enable fluid flow from the internal bore to the exterior of the THV, and a valved plug release system, the plug release system operatively connected to and configured adjacent to the plug capture system and the valved frac port system, such that engagement of the plug release system releases a plug to allow the plug to travel freely either uphole or downhole.

In another embodiment, the system further includes a first hydraulic channel between the electronic plug counting system and the plug capture system and wherein downhole movement of the plug piston opens the first hydraulic channel allowing hydraulic fluid to flow to a plug capture piston within the plug capture system and wherein the plug capture piston is responsive to the flow of hydraulic fluid through the first hydraulic channel to cause downhole movement of the plug capture piston.

In one embodiment, downhole movement of the plug capture piston narrows a portion of the internal bore within the plug capture system to prevent a plug from passing through the plug capture system.

In yet another embodiment, the system further includes a plug capture lock operatively connected to the plug capture system, the plug capture lock for engagement with the plug capture piston to prevent full uphole movement of the plug capture piston.

In one embodiment, the system may also include a valve piston and wherein when the plug capture system has retained a plug, the valve piston is exposed to hydraulic fluid within the internal bore to cause downhole movement of the valve system to open a valve.

In another embodiment, the electronic plug counting system includes a processor, a memory element, and power system operatively connected to a plug engagement system and to an electronically actuated solenoid valve or electric motor for controlling the flow of hydraulic fluid through a hydraulic channel wherein a plug passing through the internal bore is counted by the processor and when a pre-set number of plugs are counted, the processor opens the electronically actuated solenoid valve or causes the electric motor to engage, thereby triggering the first hydraulic event. In an embodiment, the processor memory element is pre-programmed with the plug count that the electronically actuated solenoid valve or electric motor is intended to be triggered on.

In an embodiment, the memory element can be associated with or connected to the processor and can be configured as non-volatile memory and can be programmed with the plug pass count corresponding to a particular frac stage. In an embodiment, the electronic plug counting system can be configured to count each plug that passes. Then, based on a pre-configured count, the electronic plug counting system can actuate the configured engagement system. The engagement system can be configured as an electronically actuated solenoid valve or as an electric motor based system. Whatever engagement system is configured, it will actuate after the pre-configured count has occurred. In a further embodiment, the programming stored on the memory element associated with the processor can include backup programming such that after a power cycle or other downtime event, the electronic plug counting system can resume operation. Based on the event that occurred, such as a power cycle, the program code that is run may change from what was originally set. Alternatively, the same code can be configured to resume once operation of the electronic plug counting system has been restored. If this is the case, if any plugs were missed, the system would engage on the next plug. In an alternate embodiment, the programming can be configured to take no further actions after a power cycle or other downtime event.

In another embodiment, the plug engagement system includes at least one movable pin in operative engagement with an electrical circuit, wherein engagement of a plug with the at least one pin as the plug passes through the internal bore moves the pin and connects or disconnects the electrical circuit and sends a signal to the processor that a plug has passed. The plug engagement system may include two movable pins spaced apart longitudinally in the internal bore, each pin in operative engagement with an electrical circuit, the two pins enabling the processor to determine the direction a plug has moved in the internal bore. The two pins may be spaced apart longitudinally to enable a passing plug to disengage one of the pins before engaging the other pin. The two pins may be out of phase with each other along the internal bore.

In another embodiment, another sensor type can be configured to count plugs that pass by the system. The configured sensor types can include acoustic sensors, magnetic sensors, optical sensors, radar based sensors, flow sensors, pressure sensors, or laser based sensors, each of which can be configured to detect a "count" when a plug or frac ball passes by.

In an embodiment, multiple sensors and/or sensors of different types can be configured at the same time to ensure that accurate plug counts are achieved. Alternatively, multiple plug counting systems can be configured and the counts from each system can be compared before triggering the electronically actuated solenoid valve or electric motor to engage the valved plug and/or ball capture systems.

Further, the memory element can include programming to direct the behavior of the electronically actuated solenoid valve or electric motor after actuation or after a plug and/or ball capture event has occurred. For example, the electronically actuated solenoid valve or electric motor can be configured to cycle at a pre-programmed time interval or upon the occurrence of another event. Another event can include, for example, if another plug and/or frac ball was observed by the electronic plug counting system. In this embodiment, upon the observation of the plug and/or frac ball, the electronically actuated solenoid valve or electric motor can cycle to initiate another change in the system, such as the closing of the electronically actuated solenoid valve or alternatively the actuation of another configured electronically actuated solenoid valve or electric motor.

In a further embodiment, the time between the processor determining the pre-set number of plugs have been counted and the triggering of the first hydraulic event is programmable.

In another embodiment, the invention provides a tubular hydraulic valve system for connection to a tubing string to isolate a zone of interest within a well, to access a downhole formation for fracturing the zone of interest and for hydrocarbon production, the tubular hydraulic valve system comprising: an outer sleeve having uphole and downhole connectors for attaching the tubular hydraulic valve system to a tubing string, the outer sleeve containing: an electronic plug counting system within the outer sleeve, in an embodiment, the electronic plug counting system having: at least one plug interaction surface for detecting the movement of a plug past the electronic plug counting system or another sensor for detecting the movement of a plug past the electronic plug counting system; and, a hydraulic activation system operable to activate a plug capture system when a pre-set number of plugs have moved past the electronic plug counting system; wherein the plug capture system is operatively connected to the electronic plug counting system and is responsive to the hydraulic activation system to activate a plug retention surface and thereby retain a plug within the plug capture system and seal the downhole section of the tubing string from the uphole section of the tubing string at the plug; and, a valve system operatively connected to the plug capture system, the valve system including a valve operatively connected to at least one opening in the outer sleeve and wherein the valve system is responsive to a hydraulic fluid pressure to open the valve when a plug is retained in the plug capture system.

In another aspect, the invention provides a method for activating a hydraulic valve in a completion string having a plurality of tubular hydraulic valves (THV) as in claim 1 and corresponding packer elements incorporated therein, comprising the steps of: a) pressurizing the completion string to a first pressure to set the packer elements within the well; b) increasing the pressure within the completion string to a second pressure level sufficient to effect rupture of a first shear pin within a THV; c) dropping a plug into the completion string, the plug for successive engagement with electronic plug counting systems within each THV and wherein if engagement of a plug with a THV triggers a first hydraulic event, the first shear pin ruptures to effect plug capture within the THV and valve opening; and d) increasing the pressure within the completion string to a third pressure level to effect well fracturing.

In one embodiment, each of steps b)-d) are repeated for each THV within the completion string.

BRIEF DESCRIPTION OF THE DRAWINGS

The invention is described with reference to the accompanying figures in which:

FIG. 7A illustrates the ball shortly after it enters the MFD. FIG. 7B illustrates the ball depressing a first pin of the electronic counting system. FIG. 7C illustrates the ball after it has passed the first pin but before it contacts a second pin. FIG. 7D illustrates the ball depressing the second pin. FIG. 7E illustrates the ball after it has passed the second pin.

DETAILED DESCRIPTION OF THE INVENTION

With reference to the figures, a multistage fracturing device (MFD) or tubular hydraulic valve (THV) 10 and methods of operating a MFD or THV are described.

Figure 1:
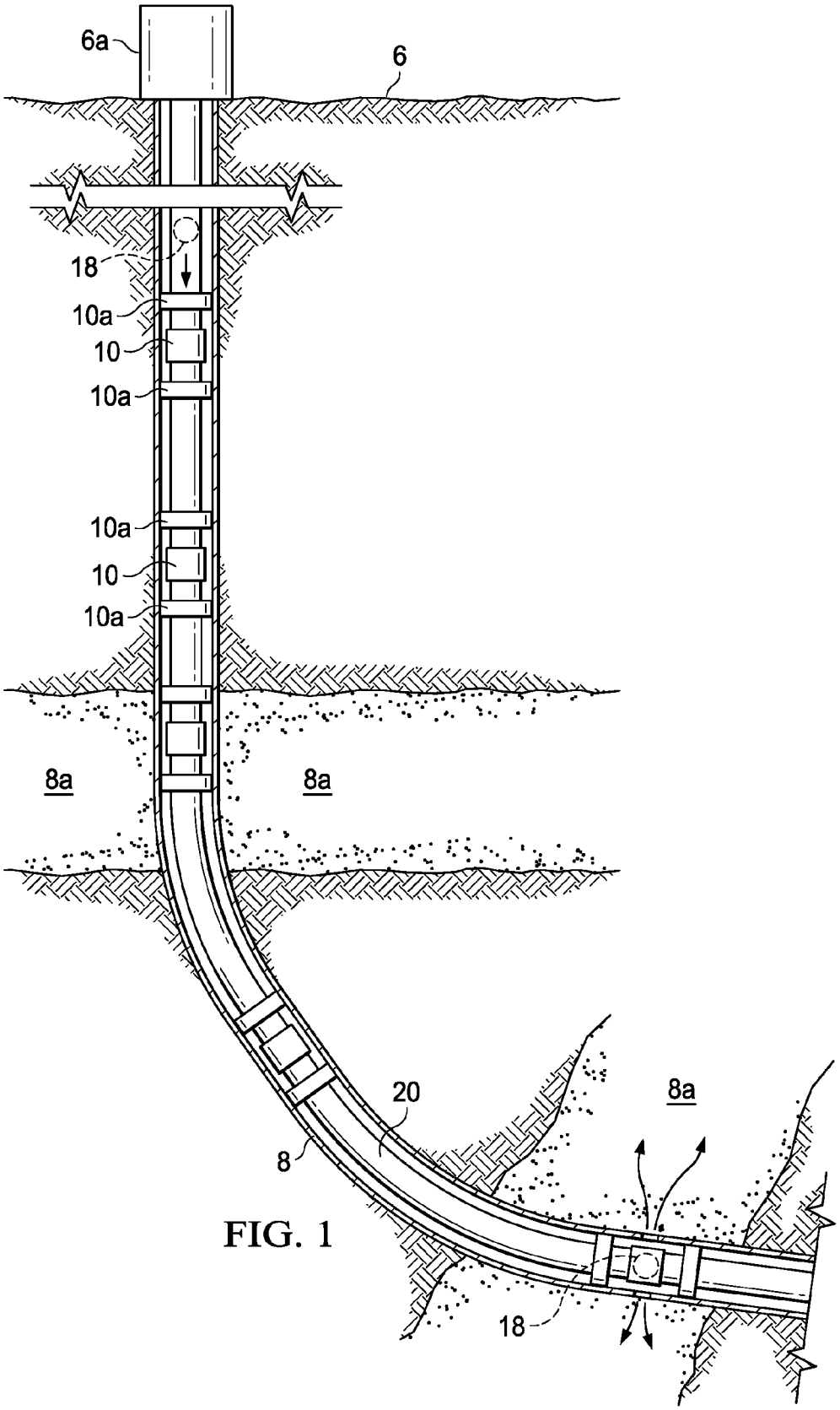
FIG. 1 is a schematic diagram of a deployed casing or completion tubing string incorporating several multi-stage fracturing devices in accordance with the invention together with corresponding packer elements.

For the purposes of description herein, the MFD or THV 10 includes a plurality of sub-systems that may be configured to a casing or completion tubing string 20 together with appropriate packer elements 10*a* to enable the isolation of particular zones within a formation 8*a* as shown in FIG. 1. In the context of this description a casing or completion string are synonymous and are referred to hereafter as a completion string. The combination of MFDs 10 and packer elements 10*a* on a completion tubing string 20 enable fracturing operations to be conducted within a formation 8*a* within a well 8.

It should also be noted that the system may be utilized without packer elements in situations for example where the completion string is cemented in place. While the following description assumes the use of packer elements 10*a*, this is not intended to be limiting.

As described in detail below, the MFD includes generally includes an electronic ball counting and valve actuation sub-system 12, a valved ball-capture sub-system 14 and a valved ball release sub-system 16 as shown schematically in FIG. 2.

It should be noted that the description utilizes various terms interchangeably with other terms for the purposes of functional description and/or to represent examples of specific embodiments. Importantly, the use of one term as compared to another is not intended to be limiting with regards to the scope of interpretation by those skilled in the art. For example, the description refers to the system as a multistage fracturing device (MFD) which is synonymous to a tubular hydraulic valve (THV) as well as to a "ball" or "plug" where a ball is but one example of a plug.

Operational Overview

With reference to FIG. 1, a number of MFDs 10 are connected to a completion tubing string 20 between packer elements 10*a* at positions that correspond to zones of interest (formations) 8*a* within the well. Generally, after placement of the completion tubing string 20 within the well 8, the assembled system can be pressurized at surface 6 through wellhead equipment 6*a* to cause the packer elements 10*a* to seal against the well 8. After circulation has been established in the well, balls 18 are released at surface 6 within the completion tubing string that fall and/or are pumped through the completion tubing string to successively engage with each MFD 10. Each MFD 10 within the string has been pre-configured to "count" each time a ball passes by the MFD and to trigger the capture of the ball 18 when the pre-determined count number is achieved. At the pre-determined count number (eg. 1-40), a specific MFD 10 will capture the ball 18 (see lowermost MFD 10 in FIG. 1). When a ball 18 is captured, the ball 18 seals the interior of the completion tubing from the lower regions of the completion tubing string such that additional hydraulic events can be initiated to open a valve within the MFD. That is, when the ball has been captured and a valve in the MFD 10 is opened a fracturing operation can be completed within a zone of interest 8*a* adjacent that MFD 10.

After a zone 8*a* has been fractured, further balls are successively introduced into the completion tubing to enable successive MFDs to be opened and fracturing operations to be completed within other zones. As a result, each of the zones of interest within the well 8 can be successively fractured. The balls may be designed such that over a period of time, typically a few days, the ball will at least partially dissolve such that its diameter is eroded and it will fall to the bottom of the well. Thus, after all fracturing operations have been completed all the zones of the well are then opened to the interior of the completion tubing to enable production of the well through the completion tubing.

The lowermost zone of the completion string may not require an MFD 10. A simple hydraulic valve that opens on pressure can be utilized at the lowermost zone (not shown) to initially establish circulation and to enable fracturing of the lowermost zone.

Figure 2:
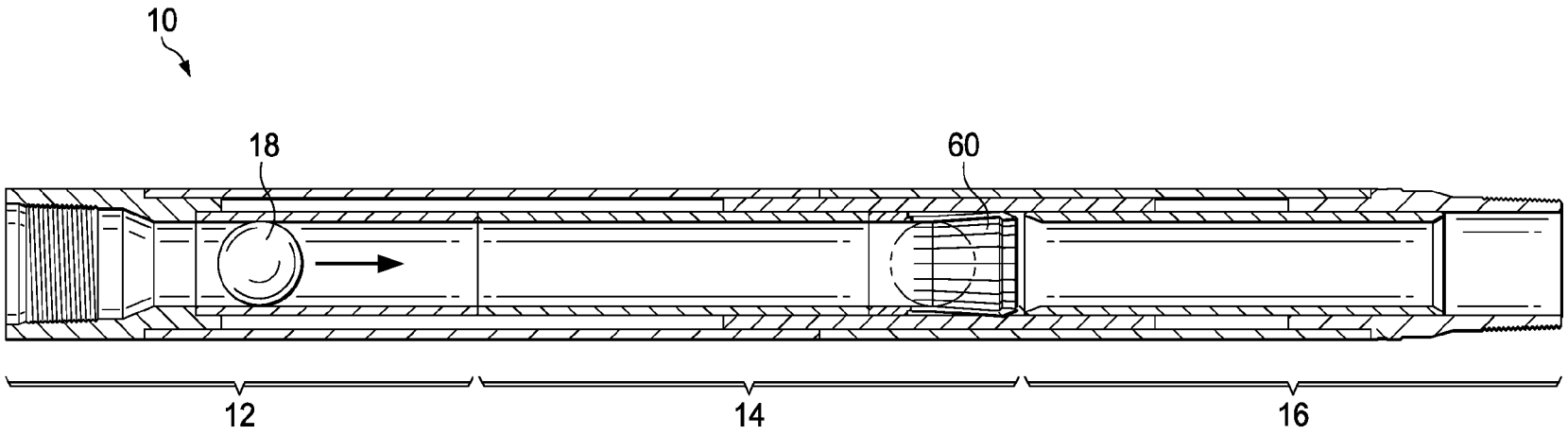
FIG. 2 is a schematic diagram of a multi-stage fracturing device (MFD) showing the general position of an electronic counting and valve actuation system, a valved ball-capture system and a valved ball release capture system in accordance with one embodiment of the invention.

As shown in FIG. 2, each MFD 10 is generally described as having three main sub-systems including an electronic counting and valve actuation sub-system 12 at the uphole end of the MFD 10, a valved ball capture sub-system 14 and a valved ball release system 16. During surface preparation of the completion tubing string, the counting system of each MFD is set to count a specific or pre-set number of balls where, for example, the lowermost MFD within the string will count 1 and the uppermost MFD with count n (where n is typically between 1 and 40). In operation, if the counting system 12 records that the pre-set number has not been reached, then the ball will pass through the MFD 10 and continue to travel downhole. If an MFD 10 records that the pre-set number has been reached, the counting system 12 will trigger the ball capture system 14 to capture the ball to prevent further downhole travel. The action of capturing the ball will then enable a valve within the valve system 16 to open. By way of example, the lowermost MFD would be set to count 1 ball whereas an uppermost MFD within a string of 10 MFDs would be set to count 10 balls.

Figure 3A:
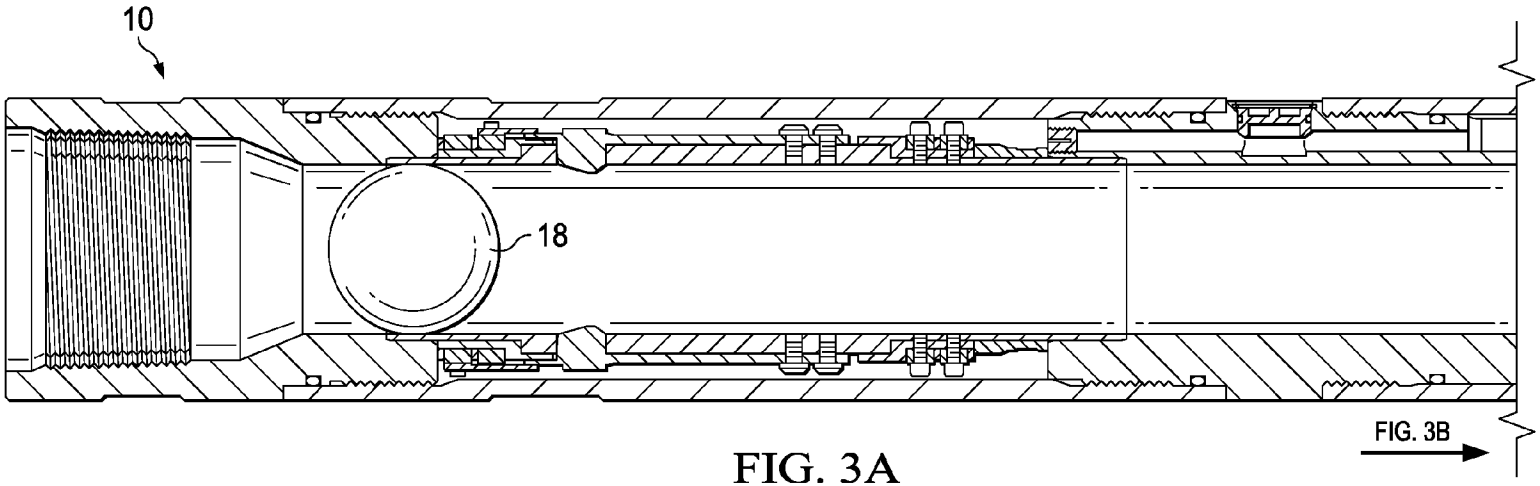
FIGS. 3A-3C are a sequence of cross-sectional views of an MFD in accordance with one embodiment of the invention showing a ball in an uphole position.
Figure 3B:
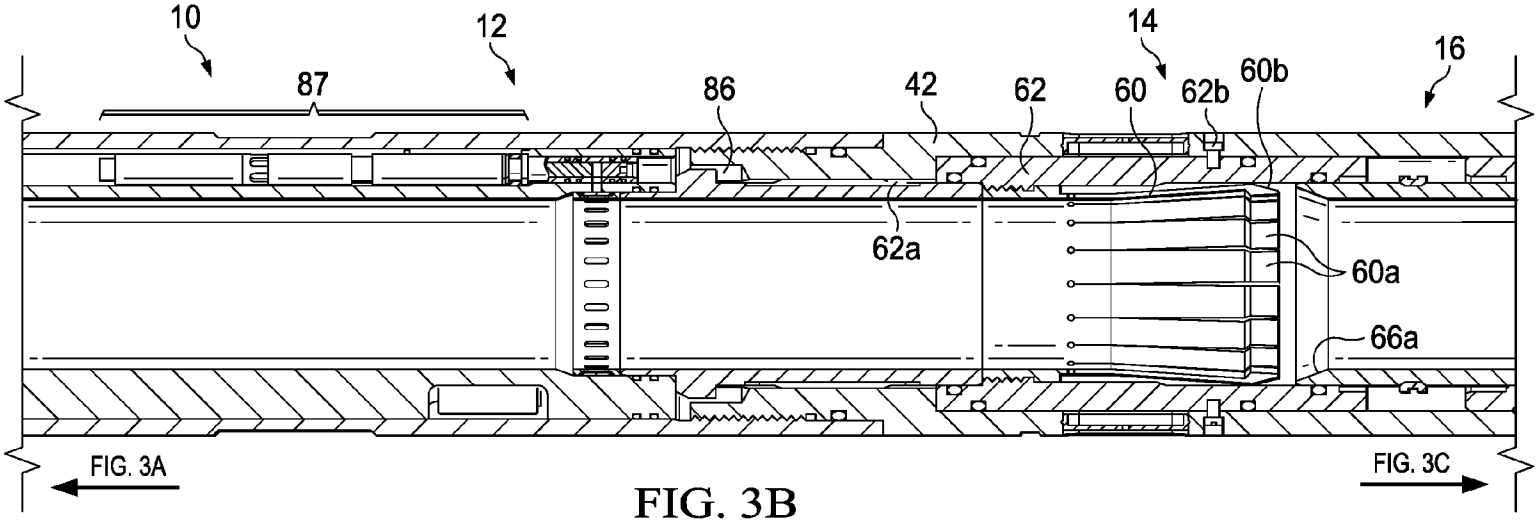
Figure 3C:
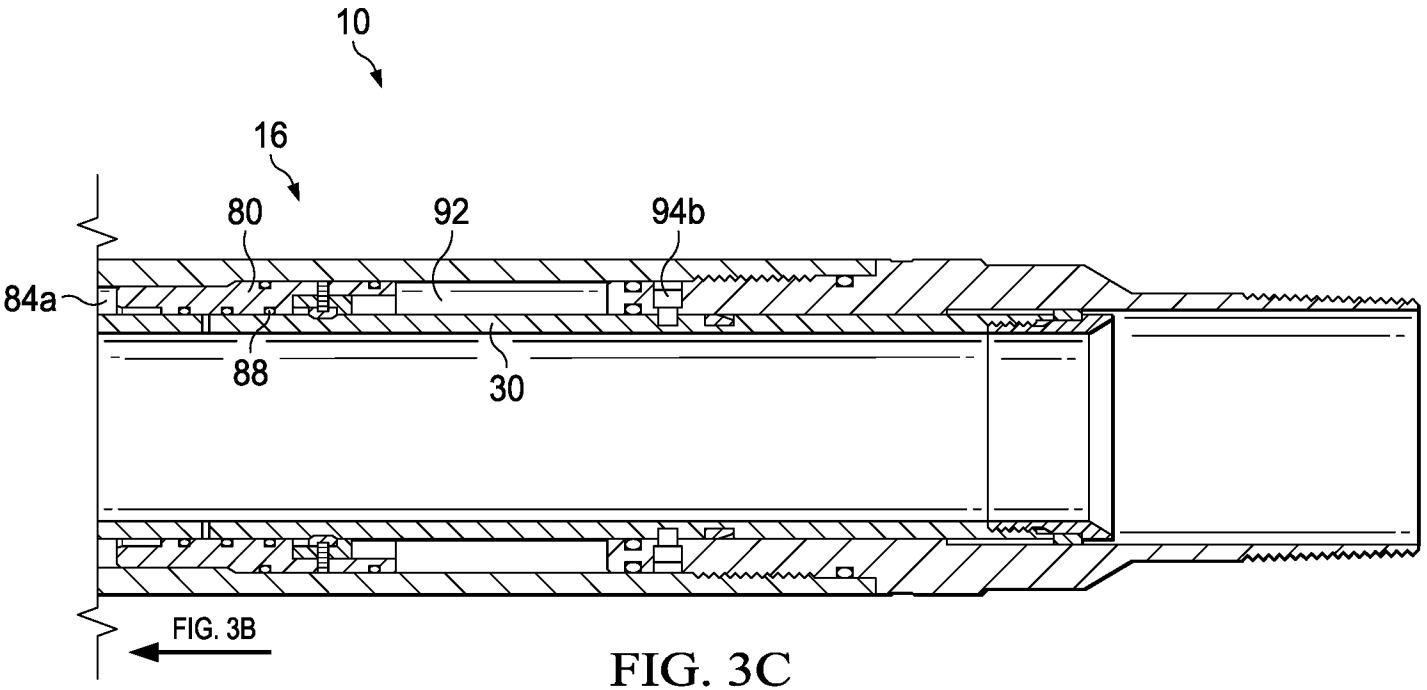

The operation and components of each of the sub-systems is described in greater detail below where FIG. 3A generally shows the uphole components of the MFD that enable connection to a tubing string via connector 30*a* and also components of the counting system, FIG. 3B shows components of the counting system and ball capture system, FIG. 3C shows details of the valved ball release sub-system. FIGS. 3A-3C generally show the system in a counting configuration that allows a ball entering the MFD to be counted. The figures are side cross-sections of the MFD. FIGS. 4A-4E generally show the sub-systems after a ball has been captured.

Electronic Counting System 12

As shown in FIG. 3A, the upper section of an MFD is shown with a ball 18 uphole of the electronic counting system 12. FIG. 3B shows a counting system 12 having an electronic counting system that successively counts balls 18 progressing through the electronic counting system 12.

The action of the electronic counting system 12 engaging the electronically actuated solenoid 87 or electric motor (depending on the embodiment) will open a pathway for fluid being pumped downhole to actuate the valved ball capture sub-system 14. More particularly, the electronically actuated solenoid or electric motor will open a channel (as shown by element 86 in FIGS. 3B, 4B and 4D), through which fluid will flow in the direction of frac piston 62, of the valved ball capture sub-system 14. As described in more detail below, the fluid flowing through said channel will cause the configuration of the valved ball capture sub-system 14 to change such that it can now capture the frac plug and/or ball 18.

In an embodiment, a further hydraulic channel can be configured such that it is contained within valve sleeve and allows hydraulic fluid to by-pass the valved ball capture system 14 to the ball release system 16.

Ball Capture System 14

Figure 4A:
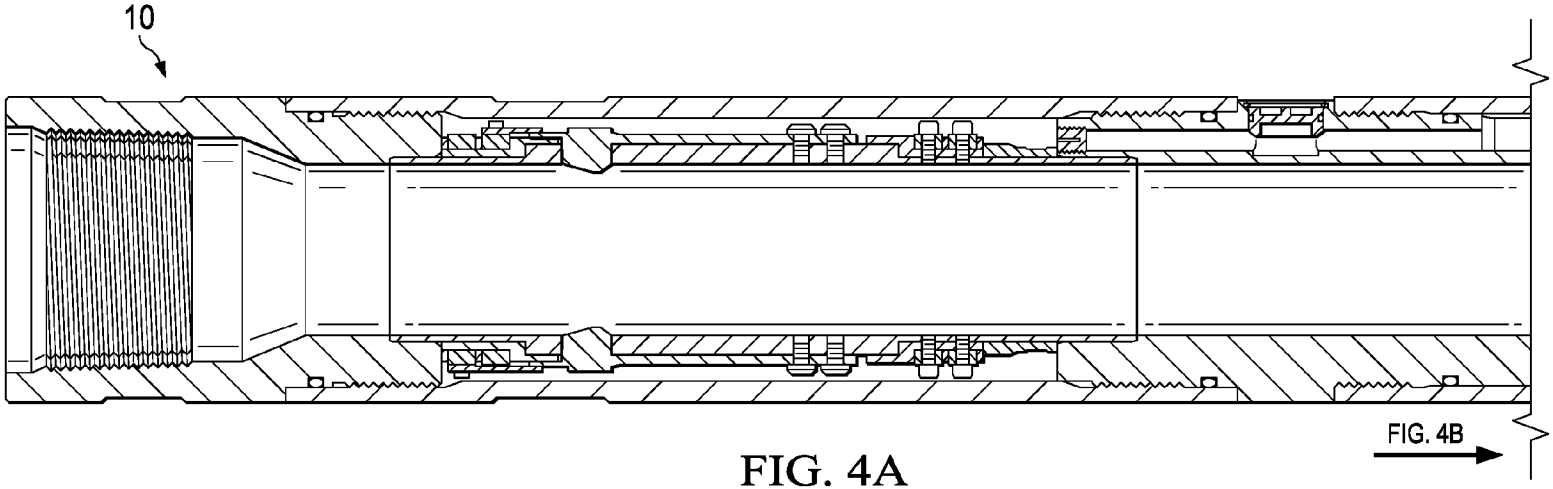
FIGS. 4A-4E are a sequence of cross-sectional views of an MFD in accordance with one embodiment of the invention showing a ball in a captured position.
Figure 4B:
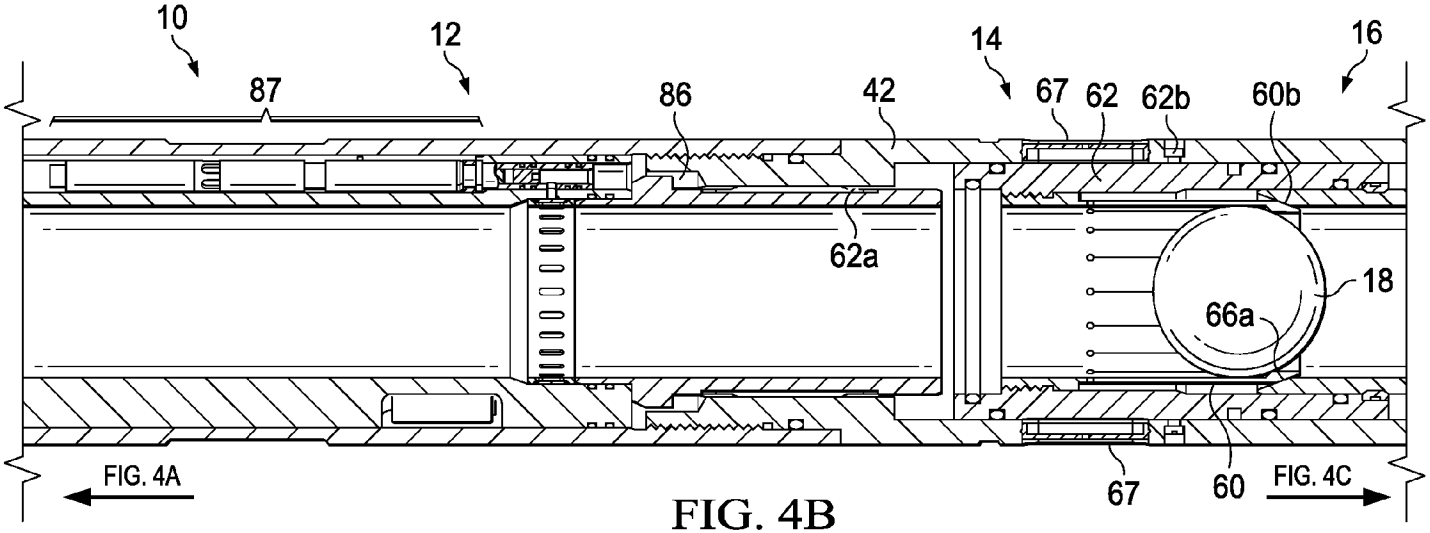
Figure 4C:
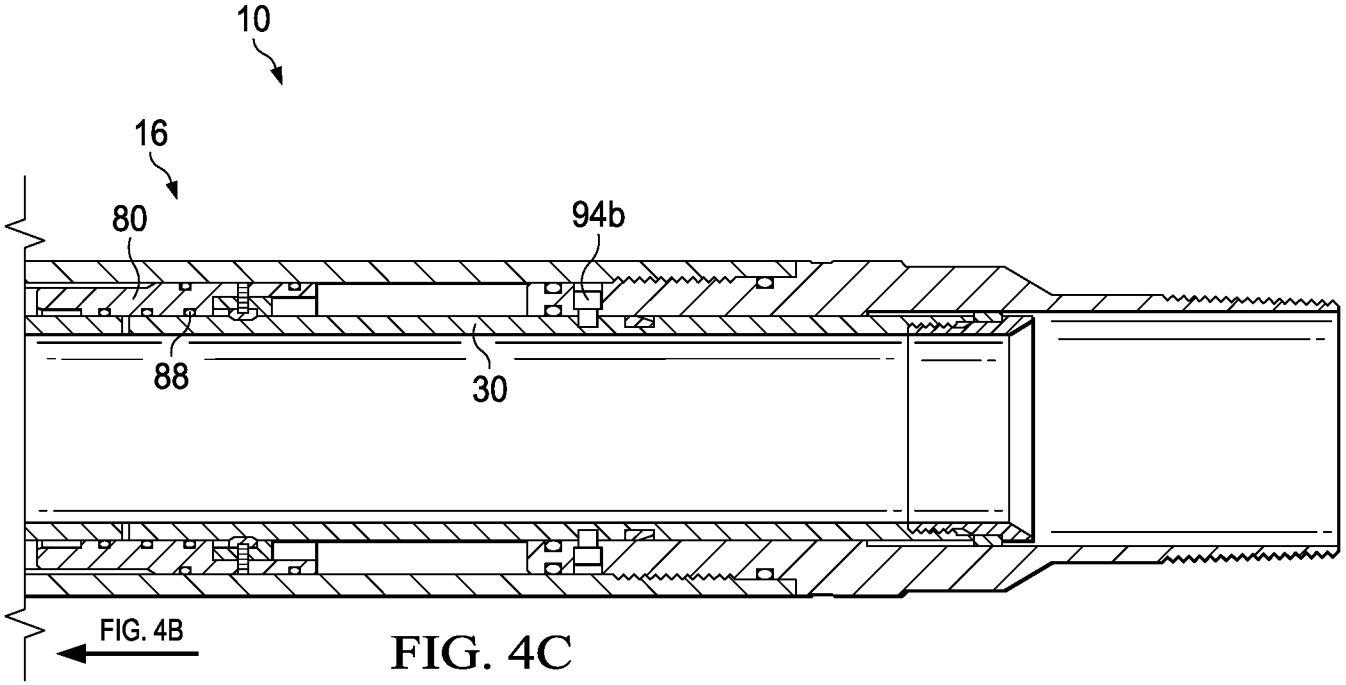
Figure 5A:
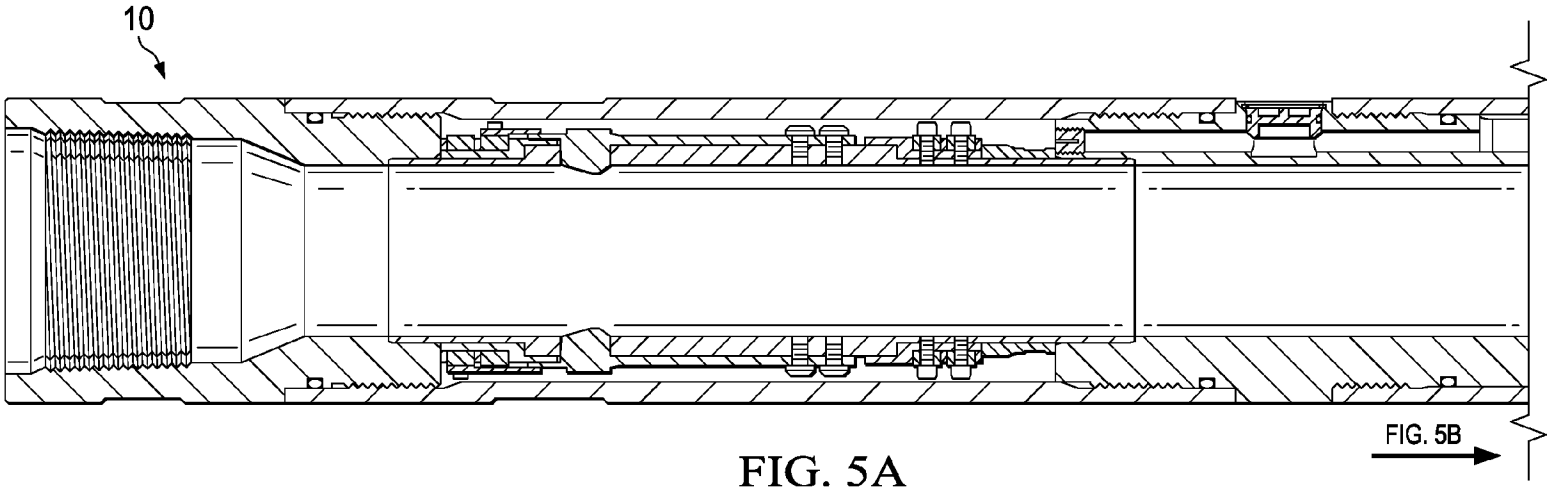
FIGS. 5A-5C are cross-sectional drawings of an MFD showing a valve sleeve in an open position.
Figure 5B:
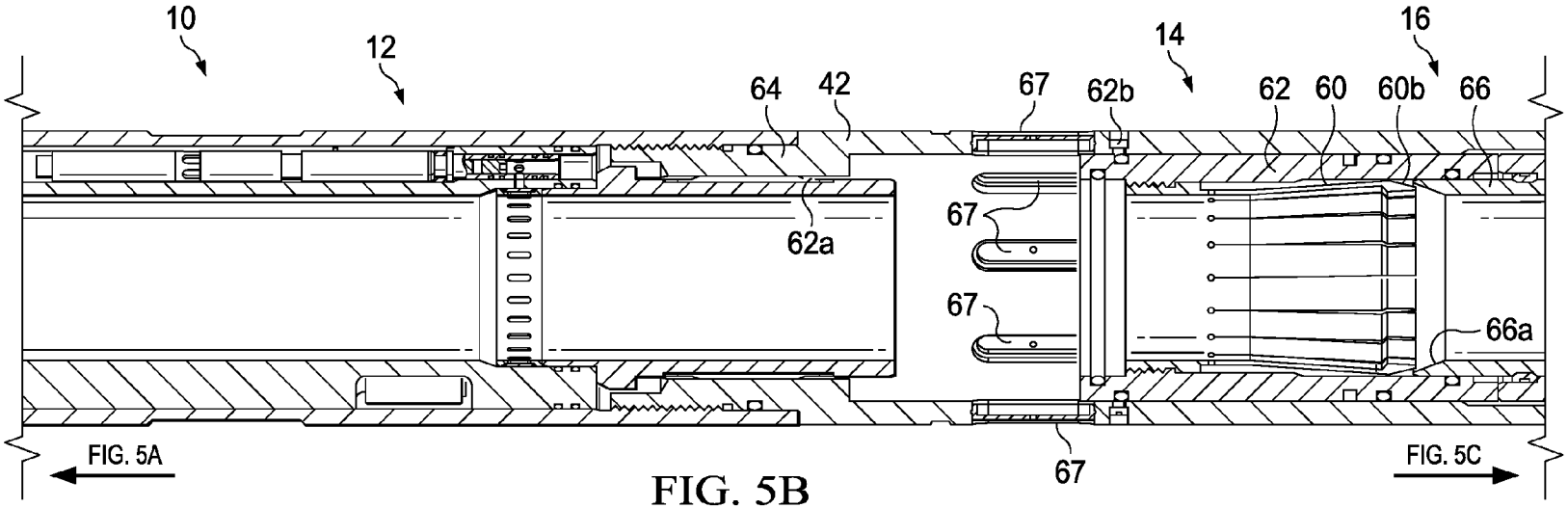
Figure 5C:
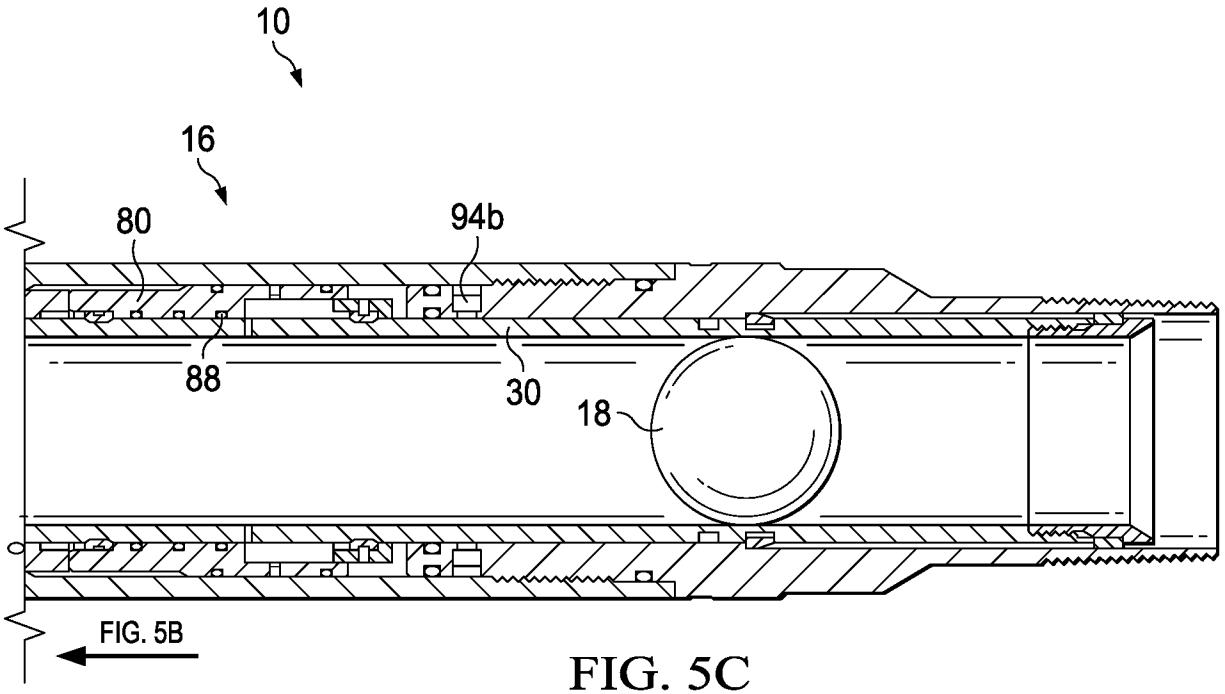

The valved ball capture sub-system 14 includes a frac piston 62. FIG. 3B shows the frac piston 62 in the closed position, before the ball seat has been set or a ball has been captured. FIG. 4B shows the frac piston 62 after a ball has been captured. FIG. 5B shows the frac piston 62 after the ball has been released.

In one embodiment, the ball capture system 14 generally includes a collet ball seat 60 having collet ball seat fingers 60*a*. The collet ball seat 60 is operatively connected to frac piston 62.

As explained in greater detail below and shown in FIG. 4B, as the frac piston 62 moves downhole, the collet ball seat 60 also moves downhole until it makes contact with inner wedge surface 66*a*. At that point, the collet ball seat fingers 60*a* move axially inward to a position that collectively define a ball retaining lip that will prevent passage of a ball 18 past the collet ball seat 60. In one embodiment, the collet ball seat fingers 60*a* have an outer wedge surface 60*b* that will engage with inner wedge surface 66*a* to facilitate positive inward movement of the collet ball seat fingers 60*a* (FIG. 4B).

In operation, as described above, the hydraulic fluid pressurizes pressure chamber 62*a* uphole of frac piston 62. Chamber pressurization causes shear pins 62*b* to shear, enabling downhole movement of the frac piston and the inward movement of the collet ball seat fingers 60*a* (FIG. 4B). It will be understood by those of ordinary skill in the art that any discussion herein relating to shear pins should also encompass the use of shear rings or other comparable structures.

If a ball has not been captured within the ball capture system, maintaining or increasing the pressure within the tubing string does not enable the frac piston 62 to move and cause premature opening of hydraulic ports 67 in a zone where a ball has not been captured. More specifically, this is prevented in a non-triggered MFD because hydraulic fluid cannot flow into chamber 62*a*.

After a ball has been retained in the collet ball seat 60, increasing the pressure within the completion tubing will result in additional pressurization against the uphole surface of the frac piston 62. The frac piston is retained against the main outer housing 42 by shear pin(s) 62*b*. When a threshold pressure is exerted on frac piston 62, shear pin(s) 62*b* will shear, thereby allowing frac piston 62 to move in a downhole direction, thus causing the formation of a ball seat, as discussed above. Further downhole movement at that point is prevented by shear pin(s) 94*b*, as reflected in FIG. 4C.

Figure 4D:
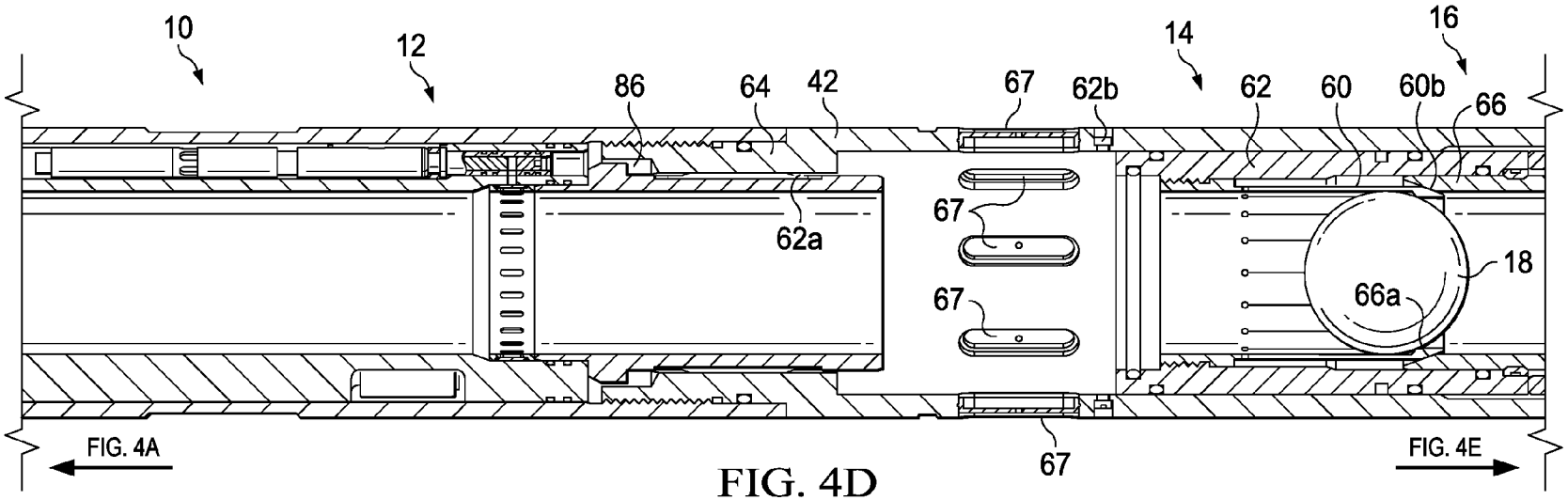
Figure 4E:
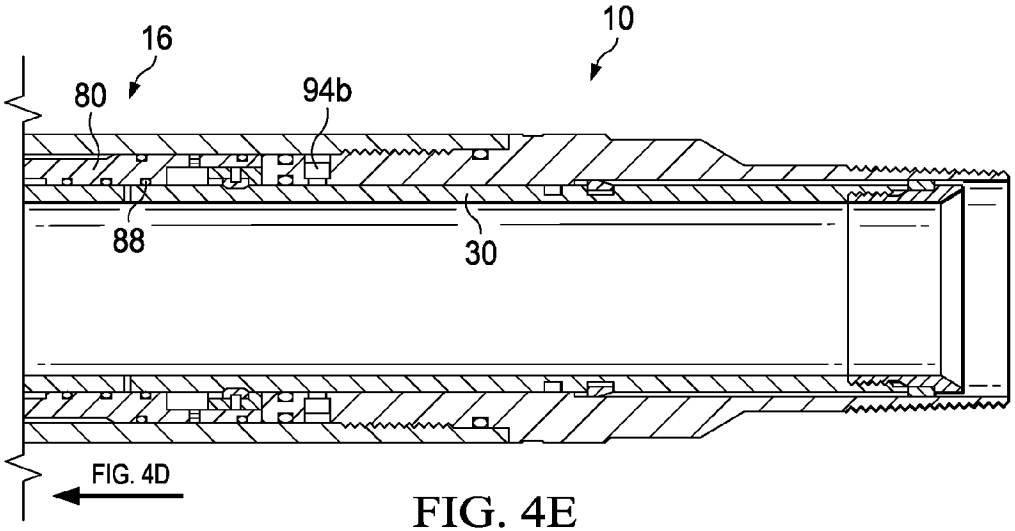

As a result, as the electronic ball count system 12 causes activation of the ball capture system 14 at the correct pre-set number, a ball 18 is retained within the collet ball seat, thus sealing off positions downhole of the ball. At that point, due to the seal created by ball 18, pressure will increase uphole from the ball seat. Once that increasing pressure has reached a threshold level, shear pin(s) 94*b* will shear (as shown in FIG. 4E), thus allowing frac piston 62 to move further downhole. This downhole movement of frac piston 62 exposes hydraulic ports 67 (as shown in FIG. 4D), thus permitting fluid to be discharged from the interior of the completion string for the purpose of fracturing the surrounding formation.

In an embodiment, the ball can be retained by alternate configurations of a collet ball seat other than that shown in the figures. For example, the collet ball seat can have more or less collet ball seat fingers than those that are shown configured. The fingers can also differ in shape, structure, and material makeup from those shown in the Figures.

Figure 9A:
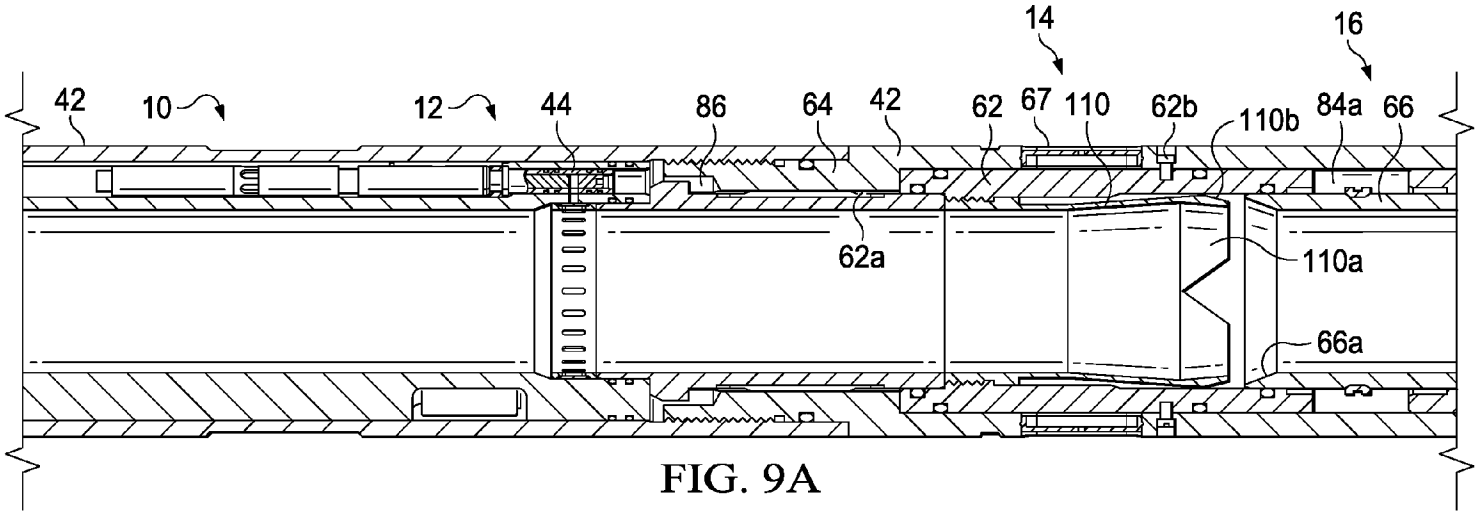
FIGS. 9A-9B are a sequence of cross-sectional views illustrating a ball capture system of an MFD in accordance with an alternate embodiment of the invention.
Figure 9B:
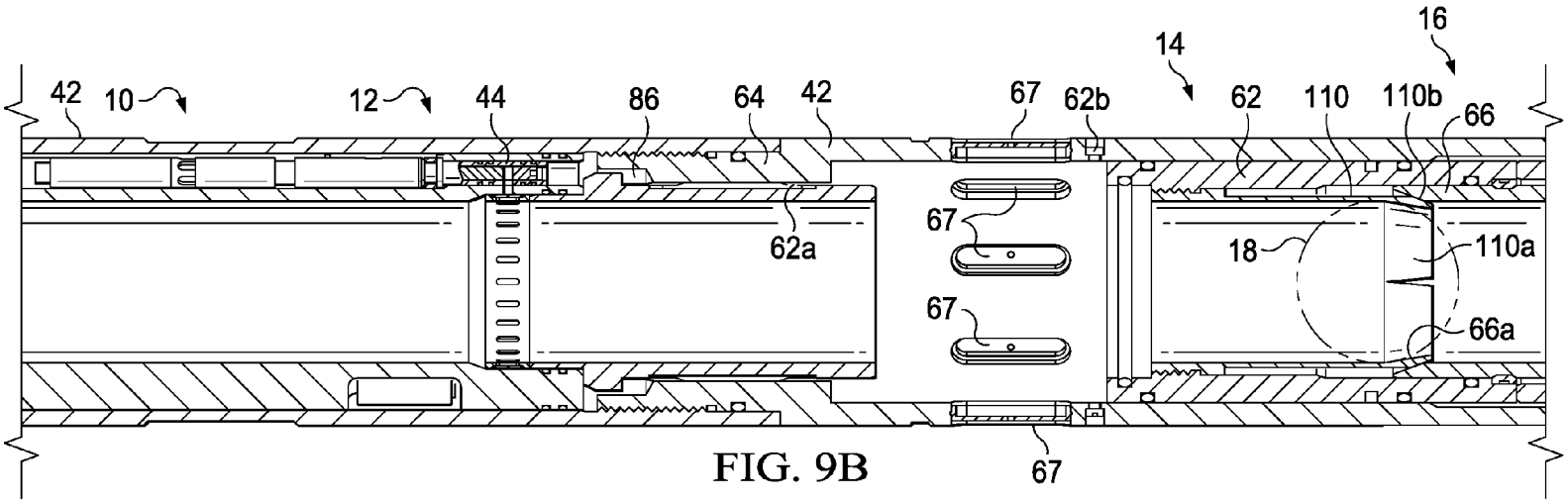

In other embodiments, ball capture system 14 may use configurations other than collet fingers, as described above. For example, as shown in FIGS. 9A and 9B, a ball seat may be formed by a metal tube 110 that is operatively connected to frac piston 62. In this embodiment, the metal tube 110 is generally cylindrical prior to the movement of frac piston 62. Metal tube 110 also has a notch cut out in the trailing (downhole) edge, as shown in FIG. 9A. When frac piston 62 moves downhole due to the increased pressure in chamber 62*a*, the trailing edge of metal tube 110*a* will contact inner wedge surface 66*a*. At that point, due to the material that has been removed, the trailing edge of metal tube 110*a* will begin to move axially inward, thus restricting the inner diameter of the MFD. When frac piston 62 has stopped moving, metal tube 110 will have become generally frusto-conical in shape, as shown in FIG. 9B. The dimensions of metal tube 110 can easily be calculated such that, at the point shown in FIG. 9B, the inner diameter of the MFD has been restricted sufficiently to catch the ball that triggered the electronic counting system. At that point, the operation of the MFD will be substantially as described above in connection with the collet finger embodiment.

The same concept could be embodied by virtually any mechanical structure that constricts its inner diameter as it moves axially downward through the inner bore of the MFD. Such structures could include a cylindrical metal tube that would buckle inward when compressed, possibly by cutting axial slots in the middle of the tube which would cause it to bias inward.

Figure 10A:
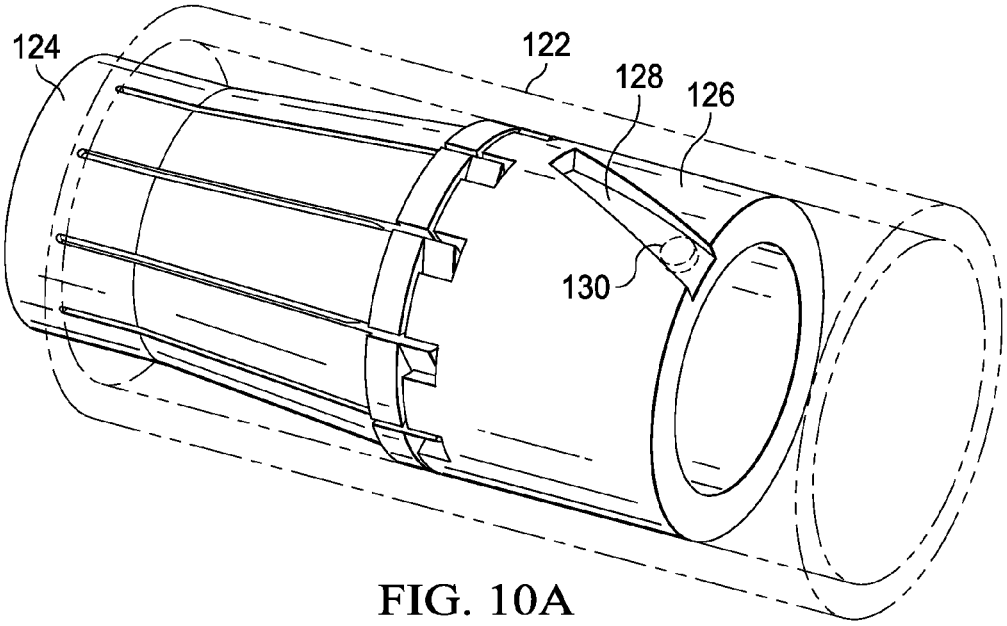
FIGS. 10A-10B are a sequence of side perspective views illustrating a ball capture system of an MFD in accordance with another alternate embodiment of the invention.
Figure 10B:
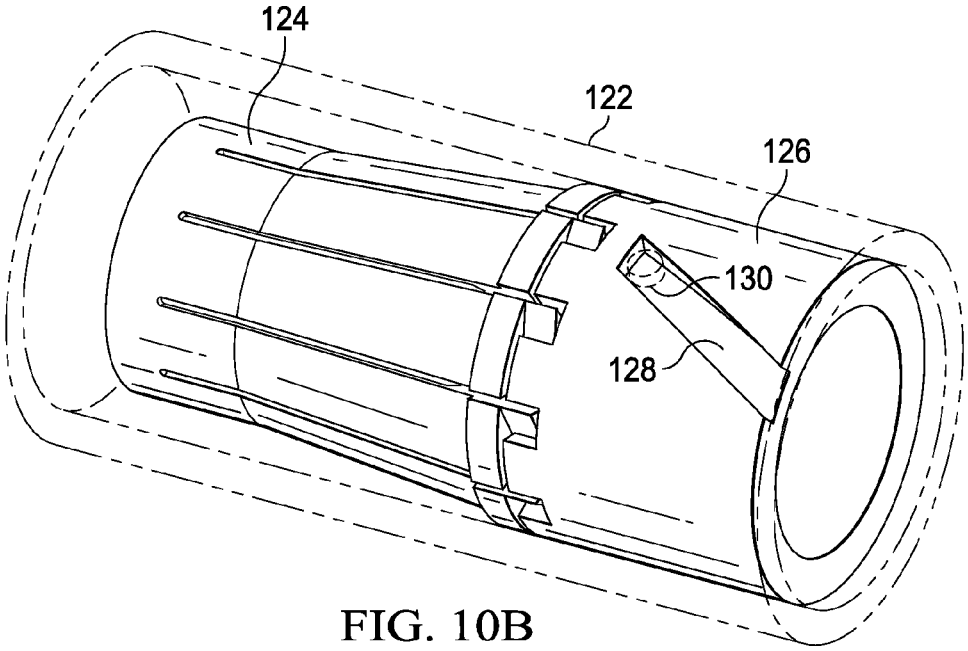

In other embodiments, the ball seat could be formed via rotation, rather than compression. For example, as shown in FIGS. 10A and 10B, the seat could be formed using a collet 124, collet ramp 126, and piston assembly 122. In this embodiment, collet ramp 126 is able to rotate, while collet 124 and piston 122 are not. Collet 124 has ramps machined into its front face and collet ramp 126 has matching ramps machined into its opposite face, as well as a helical keyway 128 machined into its outer diameter. Piston assembly 122 has a round key 130 that engages the helical keyway 128 of collet ramp 126. When the electrically actuated solenoid or electric motor of electronic counting system 12 is triggered (as discussed above), this drives the piston to one side, which causes key 130 of piston 122 to engage keyway 128 of collet ramp 126, thus causing collet ramp 126 to rotate. That rotation drives the mating surfaces of the collet 124 and collet ramp 126 together, which will cause the collet 124 to close, thus forming a ball seat.

Other rotational embodiments are certainly possible beyond that illustrated in FIGS. 10A and 10B. For example, a cylindrical tube could be buckled inward using rotation, perhaps using axial slots (as mentioned above).

Valved Ball-Release Sub-System 16

In an embodiment and as illustrated in FIGS. 3B-3C, The ball capture sub-system and the valved ball release sub-system 16 are surrounded by the pressure chamber 62*a*, the outer wall and surface facing wall of which is formed by the main outer housing 42.

In an embodiment and as illustrated in FIG. 3C, the ball release sub-system 16, can be configured to include one or more dissolving seals 88 that sit inset between the return piston 80 and the main inner housing 30. In an embodiment, once frac piston 62 has sheared shear pin(s) 94*b*, one or more dissolving seals 88 will dissolve, causing chamber 92 to fill with fluid which moves piston 80 in an uphole direction. Piston 80 will engage and exert force upon frac piston 62. That force will move frac piston 62 in an uphole direction, thus disengaging outer collet ball seat fingers 60*a* from wedge surface 60*b* and unsetting the ball seat.

Upon completion of a fracturing operation within a particular zone and the partial relaxation of pressure, the process is repeated by dropping a further ball which based on the pre-set counter setting of the immediately adjacent uphole MFD 10 will capture the further ball at that uphole position. The process is repeated for each of the MFDs present in the completion tubing string.

After completion of the fracturing operations, it is important that the balls are all released to fall to the bottom of the well or flow to the surface, thus ensuring that the entire string is opened to the formation at all zones.

As known, the balls can be dissolvable such that over a period of few days, the outer surface of the ball will erode such that it will fall from the collet ball seat arms 60*a*.

Other Design Considerations and Aspects of the System

The electronic counting system 12 will typically enable 1-40 or even more zones to be individually isolated for treatment. In order to ensure a proper pre-set number, as the completion tubing string is being assembled at surface, each MFD 10 will be set to trigger based on the intended MFD position in the well. That is, if the string includes 10 MFDs, the lowermost MFD will trigger with the first ball and uppermost MFD will trigger with the 10th ball. Thus, in an embodiment, each electronic counting system 12 will have its electronically actuated valve set to trigger on a pre-determined and pre-programmed ball count.

In an alternative embodiment, multiple MFDs can be configured to open at approximately the same time. This configuration may be referred to as a "cluster sleeve." In a cluster sleeve configuration, one MFD is used that operates substantially as described above. This MFD may be referred as the lowermost MFD. Uphole from the lowermost MFD, one or more MFDs are used with certain variations from the structure and operation described above. These MFDs may be referred to as the modified MFDs. The modified MFDs do not include collet ball seat 60 (or collet ball seat fingers 60*a*). In one embodiment of a cluster sleeve configuration, the modified MFDs also do not include shear pin(s) 94*b*, or only a reduced number and/or strength of shear pin(s) 94*b*.

In a cluster sleeve configuration, the lowermost MFD and modified MFDs are set such that the electronic counting system 12 of each MFD is configured to be triggered by the same ball. For example, if the electronic counting system of the lowermost MFD is configured to be activated after the tenth ball has been counted, then the electronic counting systems of the modified MFDs will also be activated after they have counted the tenth ball.

Because the modified MFDs do not include collet ball seat 60, even after the electronic counting system has been activated, the ball will not be captured by any of the modified MFDs. Instead, the ball will continue downhole, where it will be captured by the lowermost MFD after being counted by the electronic counting system of the lowermost MFD. Once the ball is captured, the lowermost MFD will operate substantially as described above.

In the cluster sleeve configuration where the modified MFDs have no (or fewer and/or weaker) shear pin(s) 94*b*, even though a ball has not been captured, hydraulic ports 67 in the modified MFDs will open shortly after the electronic counting system 12 has been activated. This is due to the relative absence of shear pin(s) 94*b* within the modified MFDs.

In the cluster sleeve configuration where the modified MFDs do include approximately the same number and strength of shear pin(s) 94*b* as the lowermost MFD, hydraulic ports 67 in the modified MFDs will not open until a ball has been captured in the lowermost MFD and pressure has increased to the point that shear pin(s) 94*b* will shear. Thus, in this embodiment, hydraulic ports 67 would open in all of the MFDs—both the modified MFDs and the lowermost MFD—at approximately the same time.

In either embodiment of the cluster sleeve configuration, once the electronic counting system 12 within each MFD has counted the preset number of balls, the lowermost MFD has captured a ball, and the pressure within the lowermost MFD has increased the point that shear pin(s) 94*b* have been sheared and hydraulic ports 67 have been opened in the lowermost MFD, hydraulic ports 67 will be open in every MFD within the cluster sleeve configuration at the same time.

As a result, when pressure is further increased to the level desired for hydraulic fracturing operations, fluid will be discharged from hydraulic ports 67 of every MFD in the cluster sleeve configuration at approximately the same time. In this way, any number of different stages can be treated simultaneously. For example, if a cluster sleeve configuration included a lowermost MFD and three modified MFDs, four stages would be fractured at the same time.

Additional Embodiments of Electronic Counting System

Figure 6:
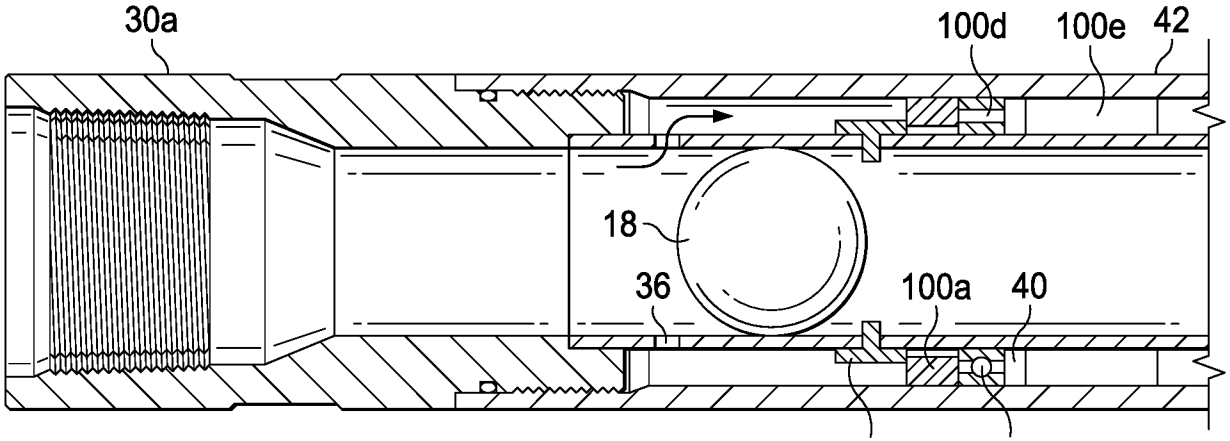
FIG. 6 is a schematic diagram of an electronic ball counting system in accordance with one embodiment of the invention.

In another embodiment as shown in FIG. 6, the counting system incorporates an electronic counting system 100. In this embodiment, the system includes a processor and power system 100*a* operatively connected to a pin system 100*b* and solenoid valve and/or electric motor 100*c*. In this embodiment, as a ball 18 moves past the pin system 100*b*, the processor 100*a* counts the number of balls that have passed. When the processor has counted a pre-set number of balls, the processor 100*a* activates a solenoid valve 100*c* to enable hydraulic fluid to flow through a hydraulic channel 100*d* into space 40 to engage against piston 100*e* and activate the ball capture system as described above. Hydraulic fluid enters space 40 through port 36.

In an embodiment, and as shown in FIGS. 3A-3C 4A-4C, 6, and 8A-8B, there is an MFD 10 containing an electronic counting system 100. In an embodiment, the electronic counting system includes a first and second pin 70, 72 that are spaced apart from each other in the inner bore along the longitudinal axis. The first and second pins are independently movable to contact a first and second electrical circuit, respectively, to close or complete the electrical circuits. A first and second biasing means 78, 80 bias the pins in a first position wherein the electrical circuits are complete. As a ball moves past one of the pins and contacts the pin, the pin is moved to a second position wherein the electrical circuit is open or incomplete. After the ball completely passes the pin, the biasing means causes the pin to return to the first position. Alternatively, in the first position the electrical circuit is in the incomplete or open position, and in the second position the electrical circuit is closed when the ball is in contact with the pin.

In an embodiment, the electronic counting system 12 can be configured with only one counting pin or alternatively with a larger number of pins than two if desired. Multiple pins can be configured for more accurate counting or in the event that one or more pins are damaged, the other pins can then still determined a reliable count. Alternatively, as mentioned above, other sensors can be configured and a combination of sensors can be configured, including multiple of the same sensor when desired. The counts from the various sensor types and/or same sensor types can then be compared by the processor which can either use a voting system of comparison or another method depending on what program is optimal for a given downhole environment and system.

In an embodiment, the first and second pin are preferably out of phase (not in line) with each other along the inner bore, and preferably are phased at 180 degrees from each other. While the first and second pin may be in phase/in line with each other, having them out of phase provides more even wear on the balls as they pass by the pins and provides room in the tool for the biasing means and other parts related to the electronic counting system.

Figure 7A:
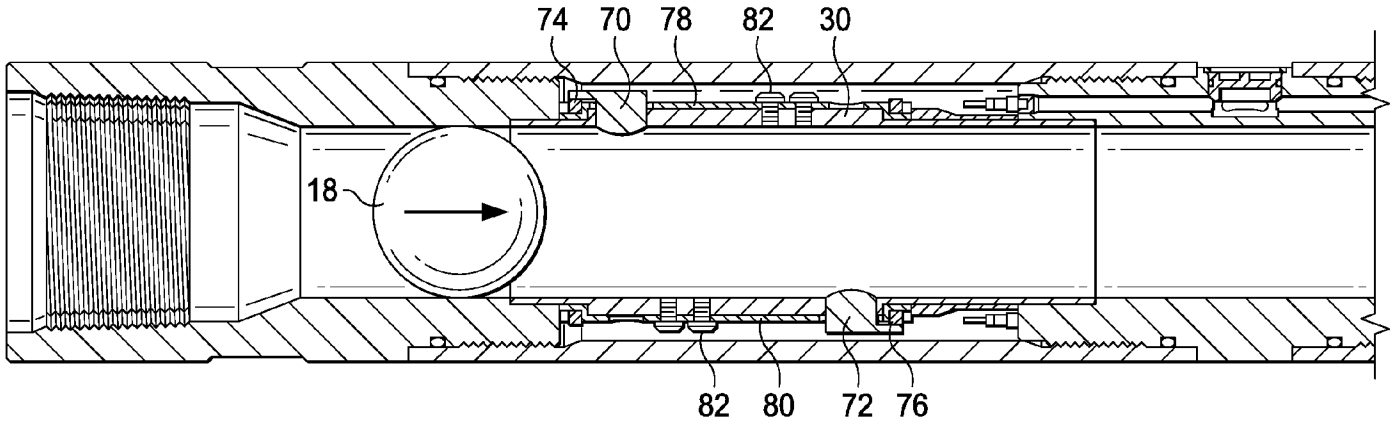
FIGS. 7A-7E are cross-sectional views of an uphole portion of an MFD having an electronic counting system illustrating a sequence of a ball moving through the MFD in accordance with one embodiment of the invention.
Figure 7B:
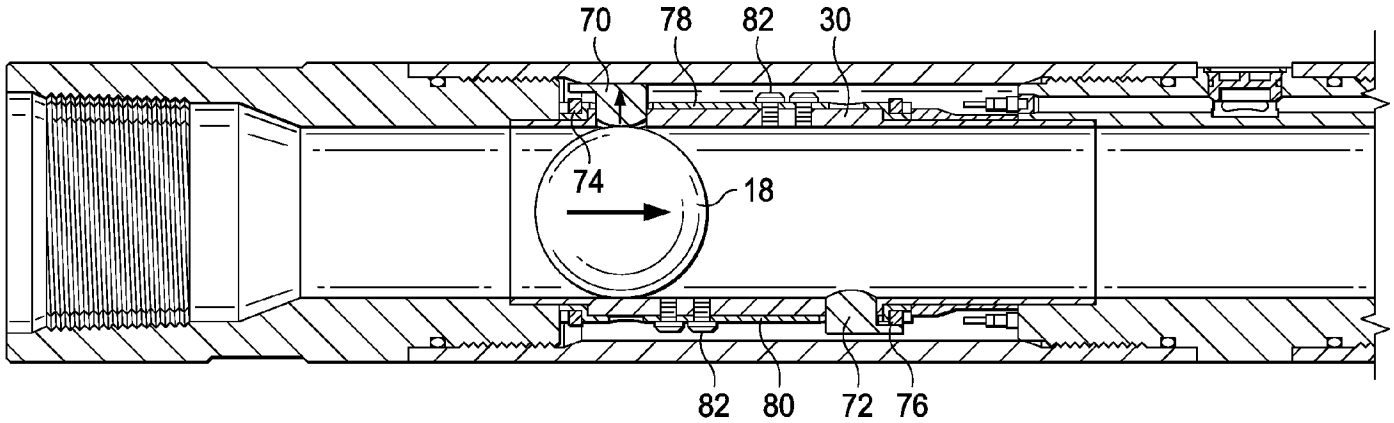
Figure 7C:
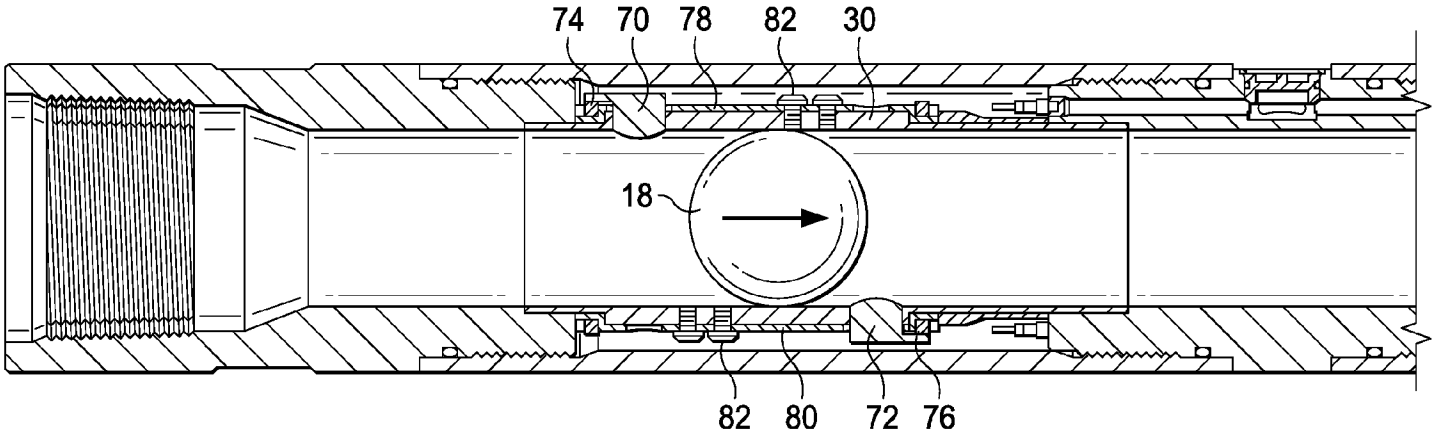
Figure 7D:
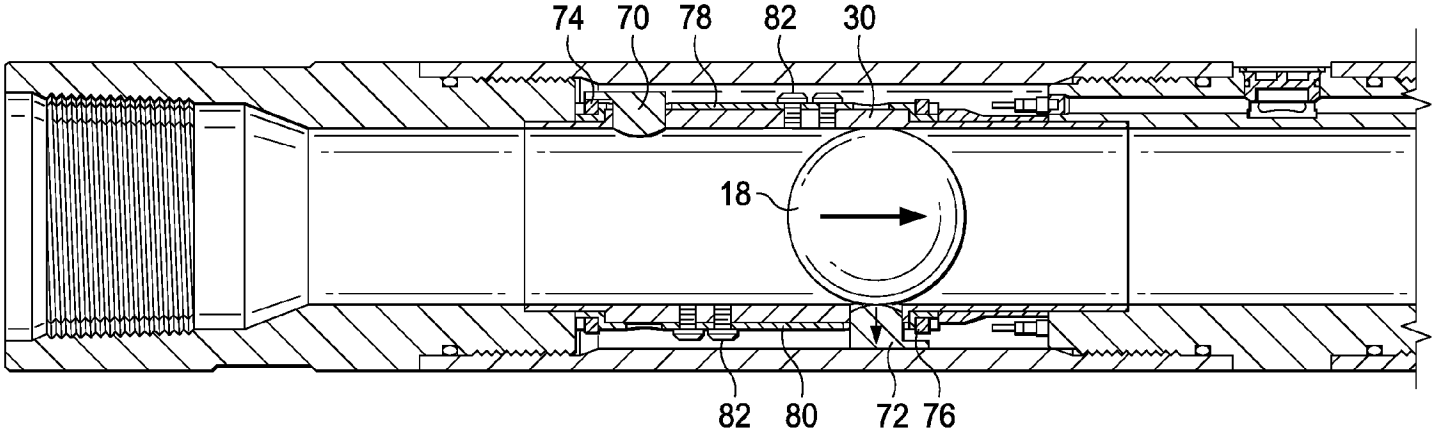
Figure 7E:
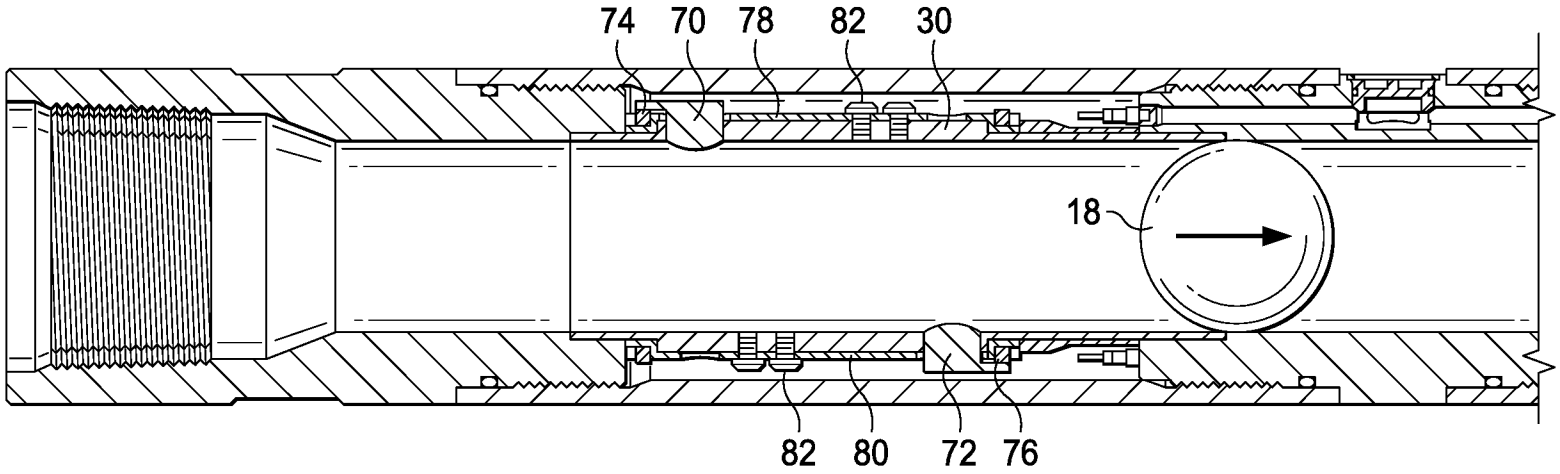

In an embodiment where two pins are configured, FIGS. 7A to 7E illustrate close up views of the sequence of a ball moving past the two pins. In this embodiment, the first and second pins are biased in a first position in contact with a first and second ring or element 74, 76 to close the first and second electrical circuits, respectively. The biasing elements 78, 80 are illustrated as beam springs fastened to the inner housing 30 by fastening means 82. When a ball 18 passes one of the pins, it pushes the pin out away from the ring or element 74, 76 into an open position to disconnect one of the electrical circuits. FIG. 7B illustrates a ball passing by the first pin 70 and pushing the pin out into an open position. FIG. 7D illustrates the ball passing by the second pin 72 and pushing the pin out into the open position. FIG. 7C illustrates the ball after it has fully passed by the first pin 70 but before it contacts the second pin 72, wherein both pins are in the closed position. The pins are spaced apart enough to allow the first pin to close after the ball has passed by before the second pin is opened. FIG. 7E illustrates the ball after it has passed by both pins.

In another embodiment, rather than first and second pins that are spaced axially apart, the electronic counting system utilizes two pairs of pins. For each pair, both pins are located at the same axial location along the inner bore of the main internal housing and, similar to the embodiment described above, the pairs of pins are axially spaced apart far enough to allow the first pair of pins to close after the ball has passed through before the second pair of pins is opened. The pins may also be circumferentially spaced apart around the inner bore of the main internal housing. For example, the first pair of pins may be located at 0° and 180° respectively, while the second pair may be located at 90° and 270°. Other similar embodiments are possible, including designs that use more than two pins at each axial location, pins located at more than two separate axial locations, or a different number of pins at one axial location versus another.

This alternative embodiment utilizing two pairs of pins is useful to reduce the likelihood that the electronic counting system will count objects other than balls or other devices designed to induce a count. For example, if coiled tubing is inserted into the well, an electronic counting system utilizing only a single pin at each axial location could inaccurately count the coiled tubing as a ball, in the event that the coiled tubing contacted the single pins, thus causing the first and second electrical circuits to open (or close). Utilizing pairs of pins as described in the preceding paragraph should ensure that the electronic counting system will only count balls or other specially designed tools or devices that have the same approximate diameter as the inner bore of the main internal housing.

When either the first or second electrical circuit open or close, a signal is passed (via wires or wirelessly) to a solenoid processor in the tool using electrical pins. In one embodiment, when a signal is passed to the processor that the first electrical circuit has opened then closed, followed shortly by the second electrical circuit opening and closing, the processor interprets this as a ball passing downhole. Alternatively, if the pins are biased in the open position, the signal to determine that a ball has passed downhole may be the first electrical circuit followed by the second electrical circuit closing then opening. The processor keeps a count number for the passing balls. Upon reaching a pre-determined count number, the processor signals a solenoid valve assembly to open, allowing fluid to enter a cavity, thereby setting the tool to capture a ball which, as with the non-electronic system described above, allows a valve in the MFD to be opened to allow fracturing operations to occur. The electronic counting system may include more than one solenoid valve assembly for redundancy and to enable the setting process to occur faster. It may be preferable to isolate the pins of the electronic counting system from the fluid that is used for hydraulic fracturing. For example, the pins may be located in an annular space that is filled with oil and isolated from the fracturing fluid using a diaphragm or other sealing device. Isolating the pins may avoid excessive current leakage if the pins are surrounded by the water that makes up a large portion of the fracturing fluid.

Figure 8A:
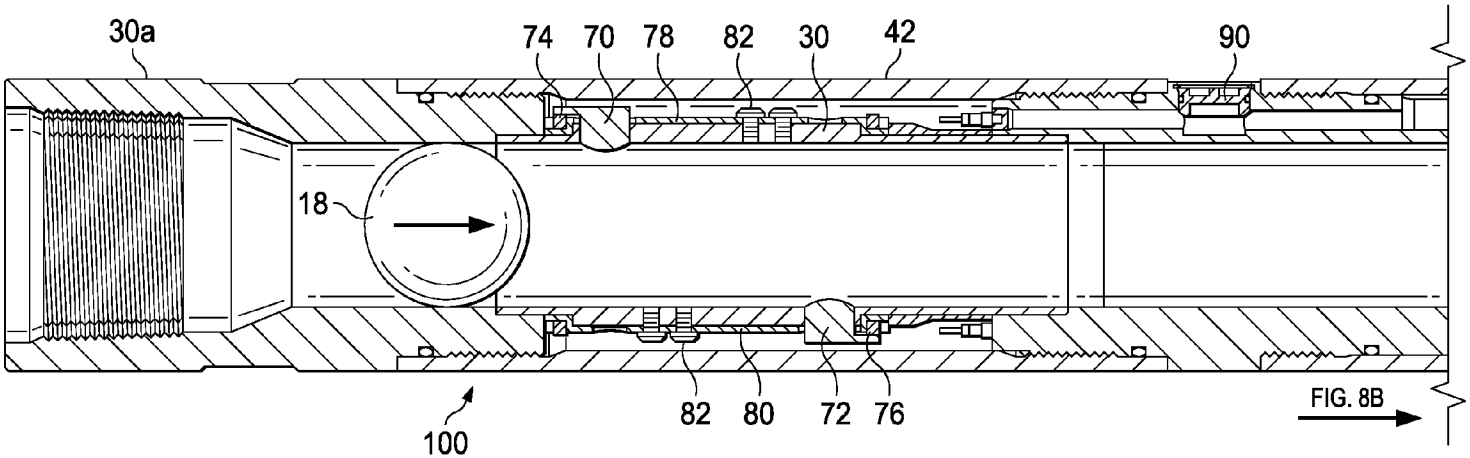
FIG. 8A is cross-sectional view of an uphole portion of an MFD having an electronic counting system showing a two pin system in accordance with one embodiment of the invention.
Figure 8B:
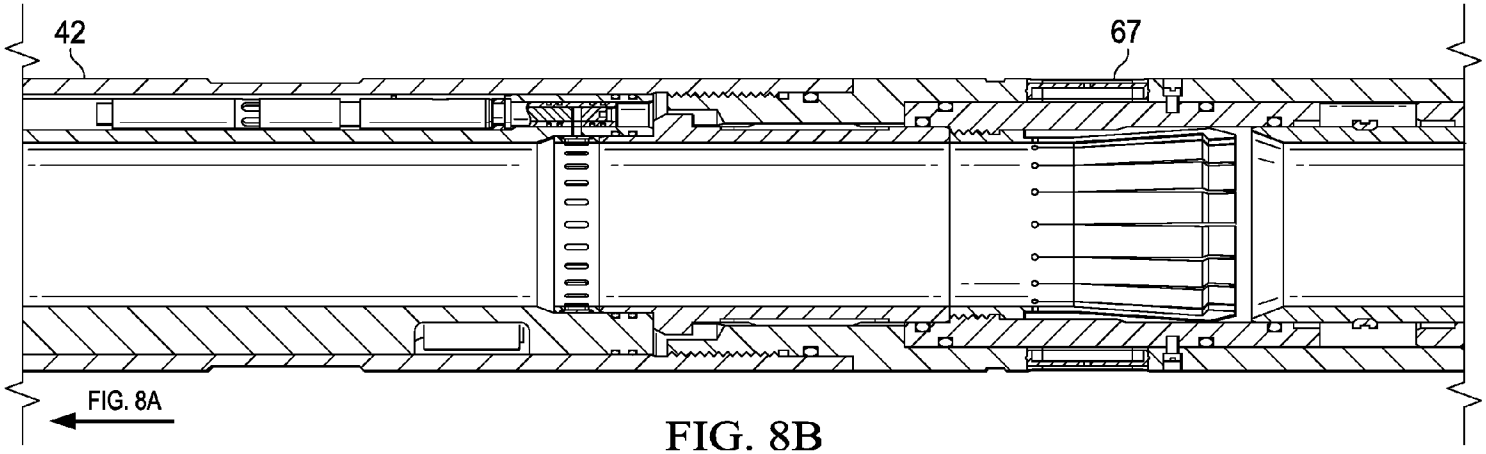
FIG. 8B is a continuation of the MFD of FIG. 8A illustrating a cross-sectional view of a middle portion of the MFD having an electronic counting system showing a solenoid valve system in accordance with one embodiment of the invention.

Referring to FIG. 8A, the tool may also include one or more ports or plugs 90 which provide access to the electronics of the counting system for programming the counting system. The tool preferably also contains a power source for the electronic counting system, such as one or more batteries (not shown).

The electronic counter system is not limited to a maximum number of ball counts and therefore has no limit on the number of fracturing stages that the MFD can be used for. The response time after a ball has passed the pins to the setting of the setting of the solenoid valve system can also be programmed as desired. This is particularly useful when it is desired to open more than one MFD with a single ball to simultaneously fracture more than one zone of interest. For example, the time between a ball passing an upper MFD and the setting of the upper MFD solenoid valve system can be delayed enough to allow the ball to pass through without being captured, after which the MFD is set. When the ball is captured by a lower MFD and pressure is applied downhole, both the upper and lower MFD will open, allowing fracturing to occur simultaneously in the zones adjacent both the upper and lower MFD.

Additionally, the electronic counter system can distinguish between a ball flowing downhole and ball flowing uphole. This is particularly useful when the direction of flow in a wellbore must be reversed due to a screen out (flow suddenly stopping in the wellbore) or the fracture failing to initiate. In both cases, the well is "opened up" and allowed to flow in the reverse direction back to the surface. After the desired amount of time, the flow direction is changed again to flow downhole in an attempt to start or restart the fracturing process. When flow is reversed, the balls often flow uphole with the fluid, passing the counting system in a reverse direction. The counting system will know a ball has moved uphole since the second pin will be triggered before the first pin. The processor may be programmed to not count an uphole flowing ball, or to count it as a negative. That is, when the ball moves downhole past the two pins it is counted as one, when the ball flows back uphole past the two pins, the count returns to zero, and when the ball moves back downhole past the two pins, it is again counted as one. This ensures that the count number is accurate despite the occurrence of reverse flow in the wellbore.

Pressurization

After setting the packers and prior to dropping a first ball for a MFD, well bore circulation may have to be established by increasing pressure (perhaps up to 3000 psi or more) to hydraulically shift open an annular communication device in the toe of the well. Once circulation is established, a series of balls may be dropped until one of them is captured by the MFD. Once a ball has been captured, pressure will increase until the hydraulic ports open, which may be in the range of 2500-4500 psi, depending on the shear pin configuration. Once the hydraulic ports in the MFD have opened, fracturing will typically occur in the range of 4000-10,000 psi.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A tubular hydraulic valve (THV) system for connection to a tubing string to enable isolation of a zone of interest within a well, to enable access to a downhole formation for fracturing the zone of interest and for hydrocarbon production, the THV having an internal bore enabling a plurality of plugs, each with substantially the same diameter, to pass through the THV, the THV comprising:

one or more ports in the outer surface of the THV which, when opened, allow fluid to be pumped out of the internal bore of the THV;

an electronic plug counting system having an uphole end for connection to a tubing string and configured to count successive plugs passing through the electronic plug counting system and to trigger the opening of a channel upon counting a predetermined number of plugs;

a frac piston that is movable between a first position, a second position, and a third position, in which the ports in the outer surface of the THV are closed when the frac piston is in the first position and second position and open when the frac piston is in the third position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel;

means for restricting the internal bore of the THV when the frac piston shifts from the first position to the second position;

the frac piston further configured such that it will move from the second position to the third position as a result of increased fluid pressure within the internal bore of the THV after a plug has been captured by the means for restricting.

2. The tubular hydraulic valve system of claim 1 further comprising:

one or more first shear pins that initially prevent the frac piston from moving from the first position to the second position, the one or more first shear pins configured such that, when fluid flows through the channel into the chamber, increased fluid pressure within the chamber will cause the one or more first shear pins to shear, allowing the frac piston to move from the first position to the second position.

3. The tubular hydraulic valve system of claim 2 further comprising:

one or more second shear pins that initially prevent the frac piston from moving from the second position to the third position;

the one or more second shear pins configured such that, when a plug is captured by the means for restricting, increased fluid pressure within the internal bore of the THV will cause the one or more second shear pins to shear, allowing the frac piston to move from the second position to the third position, resulting in the opening of the ports in the outer surface of the THV.

4. The tubular hydraulic valve system of claim 1 wherein the electronic plug counting system further comprises a processor.

5. The tubular hydraulic valve system of claim 4 wherein the electronic plug counting system further comprises at least one moveable pin in operative engagement with an electrical circuit, wherein engagement of a plug with the at least one moveable pin as the plug passes through the internal bore moves the pin and connects or disconnects the electrical circuit, thus sending a signal to the processor.

6. The tubular hydraulic valve system of claim 5 wherein the electronic plug counting system further comprises two or more moveable pins spaced apart axially in the internal bore, each pin in operative engagement with an electrical circuit.

7. The tubular hydraulic valve system of claim 6 wherein at least two of the two or more moveable pins are spaced apart axially a sufficient distance to enable a passing plug to disengage one of the pins before engaging the other pin.

8. The tubular hydraulic valve system of claim 7 wherein at least two of the two or more moveable pins are out of phase with each other along the internal bore.

9. The tubular hydraulic valve system of claim 5 wherein the electronic plug counting system further comprises two or more pairs of moveable pins, configured such that:

within each pair of pins, both pins are located at approximately the same axial location along the internal bore; and a first pair of pins is axially spaced apart far enough from a second pair of pins to allow a plug to disengage the first pair of pins before engaging the second pair of pins.

10. The tubular hydraulic valve system of claim 4 wherein the electronic plug counting system further comprises one or more sensors configured to send an electrical signal to the processor upon detection of a passing plug.

11. The tubular hydraulic valve system of claim 1 wherein the electronic plug counting system further comprises an electronically actuated solenoid valve which is configured to open the channel.

12. The tubular hydraulic valve system of claim 1 wherein the frac piston comprises an uphole end and a downhole end, said system further comprising:

a valved ball release sub-system comprising:

a return piston configured to exert force on the downhole end of the frac piston;

a chamber adjacent to said return piston;

a seal adjacent to said chamber, said seal formed of a material that will dissolve when exposed to the fluid pumped through the tubing string, such that after said seal has dissolved, fluid will pass into said chamber, exerting force on the return piston, which in turn exerts force on the downhole end of the frac piston, causing the frac piston to move uphole, with the result that the ball eat assembly moves radially outward and releases the captured plug.

13. The tubular hydraulic valve system of claim 1 wherein the electronic plug counting system further comprises an electric motor which is configured to open the channel.

14. A method of enabling isolation of a zone of interest within a well to enable access to a downhole formation for fracturing the zone of interest and for hydrocarbon production, the method comprising the steps of:

providing a tubular hydraulic valve (THV) system for connection to a tubing string, the THV comprising:

one or more ports in the outer surface of the THV which, when opened, allow fluid to be pumped out of the internal bore of the THV;

an electronic plug counting system having an uphole end for connection to the tubing string and configured to count successive plugs passing through the electronic plug counting system and to trigger the opening of a channel upon counting a predetermined number of plugs;

a frac piston that is movable between a first position, a second position, and a third position, in which the ports in the outer surface of the THV are closed when the frac piston is in the first position and second position and open when the frac piston is in the third position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel;

means for restricting the internal bore of the THV when the frac piston shifts from the first position to the second position;

the frac piston further configured such that it will move from the second position to the third position as a result of increased fluid pressure within the internal bore of the THV after a plug has been captured by the means for restricting;

pumping fluid into the tubing string;

conveying a plurality of plugs, each with substantially the same diameter, through the internal bore of the THV;

when the predetermined number of plugs has been reached, opening the channel such that fluid passes from the internal bore of the THV into the chamber, thus causing the frac piston to move from the first position to the second position and the means for restricting to restrict the internal bore of the THV and capture the plug that triggered the opening of the channel;

continuing to pump fluid into the tubing string, such that sufficient pressure builds within the internal bore of the THV to cause the frac piston to move from the second position to the third position, thus opening the ports in the outer surface of the THV.

15. The method of claim 14 in which the THV further comprises:

one or more first shear pins that initially prevent the frac piston from moving from the first position to the second position, the one or more first shear pins configured such that, when fluid flows through the channel into the chamber, increased fluid pressure within the chamber will cause the one or more first shear pins to shear, allowing the frac piston to move from the first position to the second position.

16. The method of claim 14 in which the THV further comprises:

one or more second shear pins that initially prevent the frac piston from moving from the second position to the third position;

the one or more second shear pins configured such that, when a plug is captured by the means for restricting, increased fluid pressure within the internal bore of the THV will cause the one or more second shear pins to shear, allowing the frac piston to move from the second position to the third position, resulting in the opening of the ports in the outer surface of the THV.

17. The method of claim 16 wherein the electronic plug counting system further comprises two or more moveable pins spaced apart axially in the internal bore, each pin in operative engagement with an electrical circuit.

18. The method of claim 17 wherein at least two of the two or more moveable pins are spaced apart axially a sufficient distance to enable a passing plug to disengage one of the pins before engaging the other pin.

19. The method of claim 18 wherein at least two of the two or more moveable pins are out of phase with each other the internal bore.

20. The method of claim 14 wherein the electronic plug counting system further comprises a processor.

21. The method of claim 20 wherein the electronic plug counting system further comprises at least one moveable pin in operative engagement with an electrical circuit, wherein engagement of a plug with the at least one moveable pin as the plug passes through the internal bore moves the pin and connects or disconnects the electrical circuit, thus sending a signal to the processor.

22. The method of claim 21 wherein the electronic plug counting system further comprises two or more pairs of moveable pins, configured such that:

within each pair of pins, both pins are located at approximately the same axial location along the internal bore; and a first pair of pins is axially spaced apart far enough from a second pair of pins to allow a plug to disengage the first pair of pins before engaging the second pair of pins.

23. The method of claim 14 wherein the electronic plug counting system further comprises one or more sensors configured to send an electrical signal to the processor upon detection of a passing plug.

24. The method of claim 14 wherein the electronic plug counting system further comprises an electronically actuated solenoid valve which is configured to open the channel.

25. The method of claim 14 wherein the frac piston of the tubular hydraulic valve system further comprises an uphole end and a downhole end, and said system further comprises:

a valved ball release sub-system comprising:

a return piston configured to exert force on the downhole end of the frac piston;

a chamber adjacent to said return piston;

a seal adjacent to said chamber, said seal formed of a material that will dissolve when exposed to the fluid pumped through the tubing string, such that after said seal has dissolved, fluid will pass into said chamber, exerting force on the return piston, which in turn exerts force on the downhole end of the frac piston, causing the frac piston to move uphole, with the result that the means for restricting moves radially outward and releases the captured plug.

26. The method of claim 14 wherein the electronic plug counting system further comprises an electric motor which is configured to open the channel.

27. A cluster sleeve system comprising:

a first tubular hydraulic valve (THV) system comprising:

an internal bore enabling a plurality of plugs, each with substantially the same diameter, to pass through the THV;

an electronic plug counting system having an uphole end for connection to a tubing string and configured to count successive plugs passing through the electronic plug counting system and to trigger the opening of a channel upon counting a predetermined number of plugs;

a frac piston that is movable between a first position, a second position, and a third position, in which the ports in the outer surface of the THV are closed when the frac piston is in the first position and second position and open when the frac piston is in the third position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel;

means for restricting the internal bore of the THV when the frac piston shifts from the first position to the second position;

the frac piston further configured such that it will move from the second position to the third position as a result of increased fluid pressure within the internal bore of the THV after a plug has been captured by the means for restricting; and a second tubular hydraulic valve (THV) system comprising:

an internal bore enabling a plurality of plugs, each with substantially the same diameter, to pass through the THV;

an electronic plug counting system having an uphole end for connection to a tubing string and configured to count successive plugs passing through the electronic plug counting system and to trigger the opening of a channel upon counting the same predetermined number of plugs as the electronic plug counting system of the first THV;

a frac piston that is movable between a first position and a second position, in which the ports in the outer surface of the THV are closed when the frac piston is in the first position and open when the frac piston is in the second position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel.

28. A cluster sleeve system comprising:

a first tubular hydraulic valve (THV) system comprising:

an internal bore enabling a plurality of plugs, each with substantially the same diameter, to pass through the THV;

an electronic plug counting system having an uphole end for connection to a tubing string and configured to count successive plugs passing through the electronic plug counting system and to trigger the opening of a channel upon counting a predetermined number of plugs;

a frac piston that is movable between a first position, a second position, and a third position, in which the ports in the outer surface of the THV are closed when the frac piston is in the first position and second position and open when the frac piston is in the third position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel;

means for restricting the internal bore of the THV when the frac piston shifts from the first position to the second position;

the frac piston further configured such that it will move from the second position to the third position as a result of increased fluid pressure within the internal bore of the THV after a plug has been captured by the means for restricting; and a second tubular hydraulic valve (THV) system comprising:

an internal bore enabling a plurality of plugs, each with substantially the same diameter, to pass through the THV;

an electronic plug counting system having an uphole end for connection to a tubing string and configured to count successive plugs passing through the electronic plug counting system and to trigger the opening of a channel upon counting the same predetermined number of plugs as the electronic plug counting system of the first THV;

a frac piston that is movable between a first position, a second position, and a third position, in which the ports in the outer surface of the THV are closed when the frac piston is in the first position and second position and open when the frac piston is in the third position;

a chamber adjacent to the frac piston;

the channel configured such that, when it is opened by the electronic plug counting system, fluid passes from the internal bore of the THV into the chamber;

the frac piston configured such that it will move from the first position to the second position as a result of increased fluid pressure within the chamber caused by fluid flowing through the channel;

the frac piston further configured such that it will move from the second position to the third position as a result of increased fluid pressure within the internal bore of the THV after a plug has been captured by the means for restricting within the first THV.

* * * * *